US005103364A

United States Patent [19]

Kamp

[11] Patent Number: 5,103,364

[45] Date of Patent: Apr. 7, 1992

[54] RECLOSER APPARATUS

[75] Inventor: Eugene L. Kamp, Fulton, Mo.

[73] Assignee: A. B. Chance Company, Centralia, Mo.

[21] Appl. No.: 463,452

[22] Filed: Jan. 11, 1990

[51] Int. Cl.[5] ..... H02H 3/00

[52] U.S. Cl. ..... 361/72; 361/115; 335/20

[58] Field of Search ..... 361/72, 74, 75, 102, 361/115; 335/34, 28, 32, 27

[56] References Cited

U.S. PATENT DOCUMENTS 3,878,436 4/1975 Bogel ..... 361/72

4,604,674 8/1986 Hamel ..... 361/72

*Primary Examiner*—Todd E. DeBoer

*Attorney, Agent, or Firm*—Hovey, Williams, Timmons & Collins

[57] ABSTRACT

A recloser apparatus is provided with an enclosure or tank (40) in which a current interrupter assembly (49) is disposed that includes a pair of relatively movable contacts (50, 54) movable between a closed, current-carrying position and an open, current-interrupting position. An opening assembly (60) is included for opening the contacts to the current-interrupting position and a closing assembly (66), including a high voltage solenoid coil (61) and plunger (116) moves one of the contacts (54) to the closed, current-carrying position. An operating assembly (43) is manually accessible from outside the tank (40) and includes an operating arm (44) which is movable between an upper, intermediate and lower position, and a contact closing circuit for initiating operation of the contact closing assembly (66) when the operating arm (44) is manually moved to the upper position. When manually moved to the lower position, the operating arm (44) actuates the contact opening assembly (60) and locks out the closing assembly (66) so as to prevent subsequent movement of the contact (54) to the closed position until the operating arm (44) is moved manually from the lower position. A sensor (46) is provided for sensing a fault current experienced by the apparatus and a control assembly (47) actuates the contact opening assembly (60) in response to a sensed fault current and alternately actuates the closing and opening assemblies (66, 60) for a predetermined number of opening cycles in response to a further sensed fault current. The control assembly (47) also actuates automatic movement of the operating arm (44) to the lower position once the closing and opening assemblies (66, 60) have been actuated for the predetermined number of opening cycles such that the operating arm (44) serves as a signal that the recloser is locked out.

18 Claims, 22 Drawing Sheets

RECLOSER APPARATUS

BACKGROUND OF THE INVENTION

1. Field of the Invention

The present invention relates generally to electrical distribution equipment and, more particularly, to an electrical recloser apparatus including an electronic control assembly and an external operating assembly including an operating arm which serves as a manual opening and closing lever and also as a lockout indicator.

2. Discussion of the Prior Art

In a conventional recloser, an oil insulated interrupter is provided within a tank and an external operating mechanism is mounted to the tank so as to be accessible by a lineman.

In the known recloser constructions, the external operating mechanism includes an operating arm that is movable between upper and lower positions to manually initiate closing and opening of the contacts of the interrupter within the tank. Closing energy is typically supplied by a relatively large closing solenoid which simultaneously charges one or more opening springs in preparation for a tripping operation. During operation of the known devices, fault currents are sensed by a trip solenoid which initiates tripping of the contacts by releasing the opening springs. Thereafter, a hydraulic control mechanism carries out time-delay operations and regulates the number of operating cycles to lockout of the recloser. Examples of a single-phase recloser incorporating this construction are the Types D and DV hydraulically controlled, single-phase reclosers marketed by McGraw-Edison, while examples of a three-phase recloser of this construction are known from the Types RV, VW and WV reclosers marketed by McGraw-Edison.

Although the operating mechanism of conventional recloser devices is easy to use and has found acceptance in the field by linemen who are familiar with the operation thereof, several drawbacks have been found to exist in the use of such reclosers wherein a hydraulic control mechanism is used to carry out the timing and cycles-to-lockout regulating functions within the recloser. For example, because the fluid in the tank of a hydraulically controlled recloser is relied upon to serve as dielectric fluid, interruption fluid and timing fluid, the viscosity thereof is a factor in most of the operations carried out by the controller.

Because the viscosity of the fluid is effected by the temperature thereof, and this temperature changes significantly with the ambient temperature, the timing operations conducted by the controller may be adversely effected thus causing a delay to occur in the reclosing operation of the device such that other equipment within the distribution system that is coordinated with the specific preferred timing operations of the recloser fail to operate in the designed manner and failure of the system may result.

Further, it is difficult to program a hydraulically controlled recloser due to the requirement that hardware within the sealed interior space of the known reclosers must be replaced in order to vary timing characteristics and the like of the recloser. Typically, a consumer specifies the desired time-current characteristics and timing sequence and purchases a pre-set recloser having "fast curve" or "slow curve" attributes. Thus, in order to ensure that a desired recloser type will be in stock when needed, a utility may be compelled to purchase several reclosers with different pre-set characteristics in order to fill their need.

The use of an electronic control assembly in a recloser is known with respect to certain conventional three-phase reclosers. For example, the Types RVE, VWE and WVE three-phase reclosers marketed by McGraw-Edison employ an electronic control mechanism which functions in a manner similar to the hydraulic reclosers discussed above, but are provided with electronic control of the timing operations within the device.

In the known three-phase electronic recloser constructions, an external operating assembly is typically provided which includes an operating arm for initiating manual opening and lockout of the interrupter so that a lineman can interrupt current flow through the reclosers when carrying out maintenance on the distribution system. In addition, it is known to employ a separate indicator arm which is movable between two positions to indicate the condition of the contacts of the recloser.

Other known three-phase reclosers incorporating electronic control employ a switch box having a lever switch or the like for permitting manually actuated opening and closing of the interrupter contacts. In many of these devices, a separate indicator is provided which is movable between two positions to indicate the condition of the interrupter at any given time during operation of the recloser.

OBJECTS AND SUMMARY OF THE INVENTION

It is an object of the present invention to provide a recloser apparatus that incorporates an operating assembly having the look and feel of the operating assembly of a conventional, hydraulically operated, single-phase recloser, with an electronic control assembly providing all of the advantages of electronic control.

It is another object of the invention to provide a single-phase recloser apparatus having an electronic control assembly for controlling timing and related operations in the recloser and for permitting reprogramming of these operations after purchase of the apparatus. By providing this feature, it is possible to stock a single recloser type while permitting adaptation thereof to any one of several different uses.

In accordance with these objects, one embodiment of the invention includes a housing or tank and a current interrupter disposed within the tank having a pair of relatively movable contacts movable between a closed, current-carrying position and an open, current-interrupting position. First and second contact moving means are provided for moving the contacts to the closed and open position respectively, and an operating assembly is included which is manually accessible from outside the tank. The operating assembly has an operating arm movable between an upper, intermediate and lower position and includes contact closing means for initiating operation of the first contact moving means when the operating arm is manually moved to the upper position. The operating assembly also includes lockout actuating means for actuating the second contact moving means and for preventing subsequent operation of the first contact moving means when the operating arm is manually moved to the lower position.

Sensing means are provided in the recloser for sensing a fault current experienced by the apparatus, and a control means initially actuates the second contact moving means in response to a sensed fault current and alternately actuates the first and second contact moving means for a predetermined number of opening cycles in response to a further sensed fault current. A lockout signalling means automatically moves the operating arm to the lower position once the control means has actuated the first and second contact moving means for the predetermined number of opening cycles.

By providing a recloser in accordance with the invention, numerous advantageous results are realized. For example, by employing an electronic control assembly with the recloser, all of the advantages of electronic control are achieved. Specifically, by providing electronic control, the recloser is easily and conveniently adaptable for use in an infinite variety of environments by permitting programmability of the time-current characteristics of the recloser as well as of the number of cycles to trip and other functions of the device. Further, the electronic control system is less susceptible to failure or improper operation due to ambient temperature conditions and may be positioned to be readily accessible to linemen working on the distribution system.

BRIEF DESCRIPTION OF THE DRAWING FIGURES

A preferred embodiment of the invention is discussed in detail below with reference to the attached drawing figures, wherein.

Figure 10:
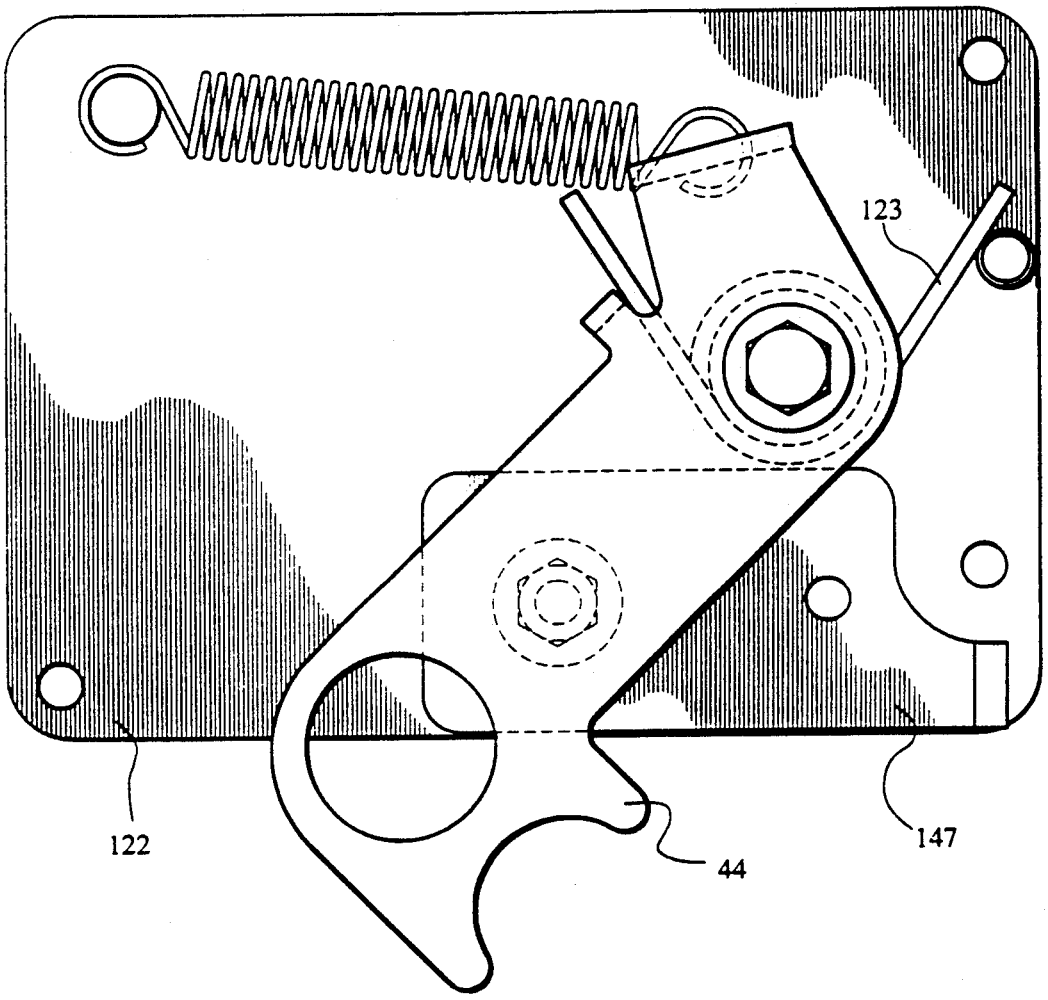
FIG. 10 is a front elevation view of the operating assembly shown removed from the recloser, with the operating arm shown in the lockout position.
Figure 31:
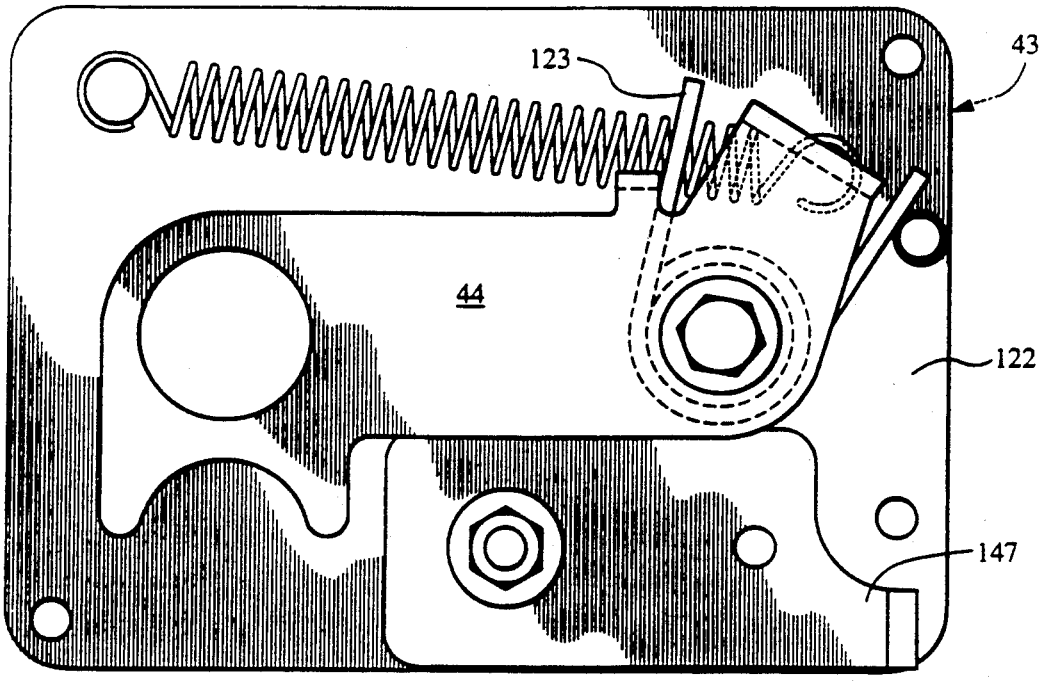
Figure 32:
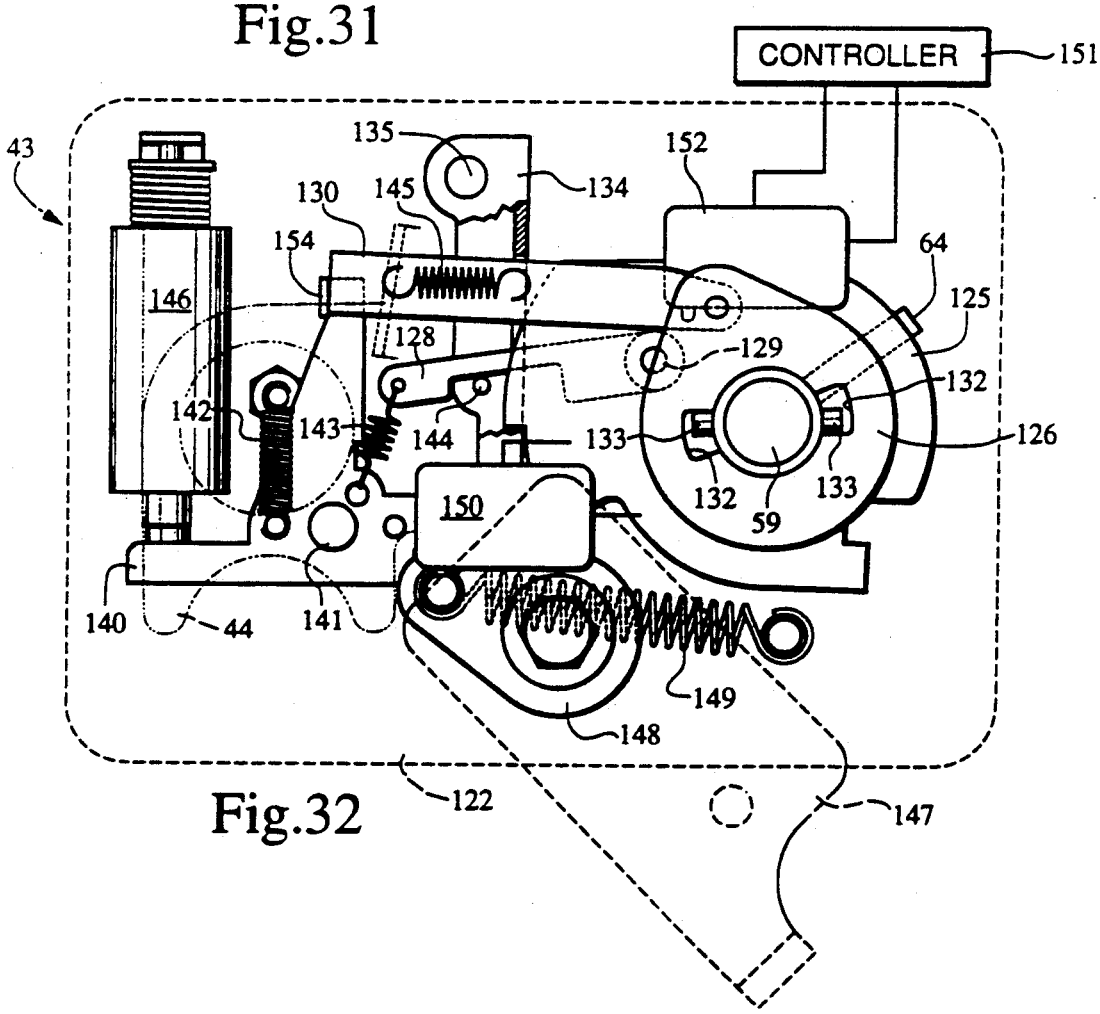

FIG. 31 is a view similar to FIG. 10, with the operating arm shown in the normal interrupter-closed position and the one-shot-to-lockout lever shown in the upper, non-actuated position; and FIG. 32 is a schematic view of the external operating assembly viewed from the front of the assembly and looking past the operating arm and through the support plate of the assembly, with the support plate, operating arm and one-shot-to-lockout lever shown in phantom, the one-shot-to-lockout lever being shown in the actuated position.

DETAILED DESCRIPTION OF THE PREFERRED EMBODIMENT

Figure 1:
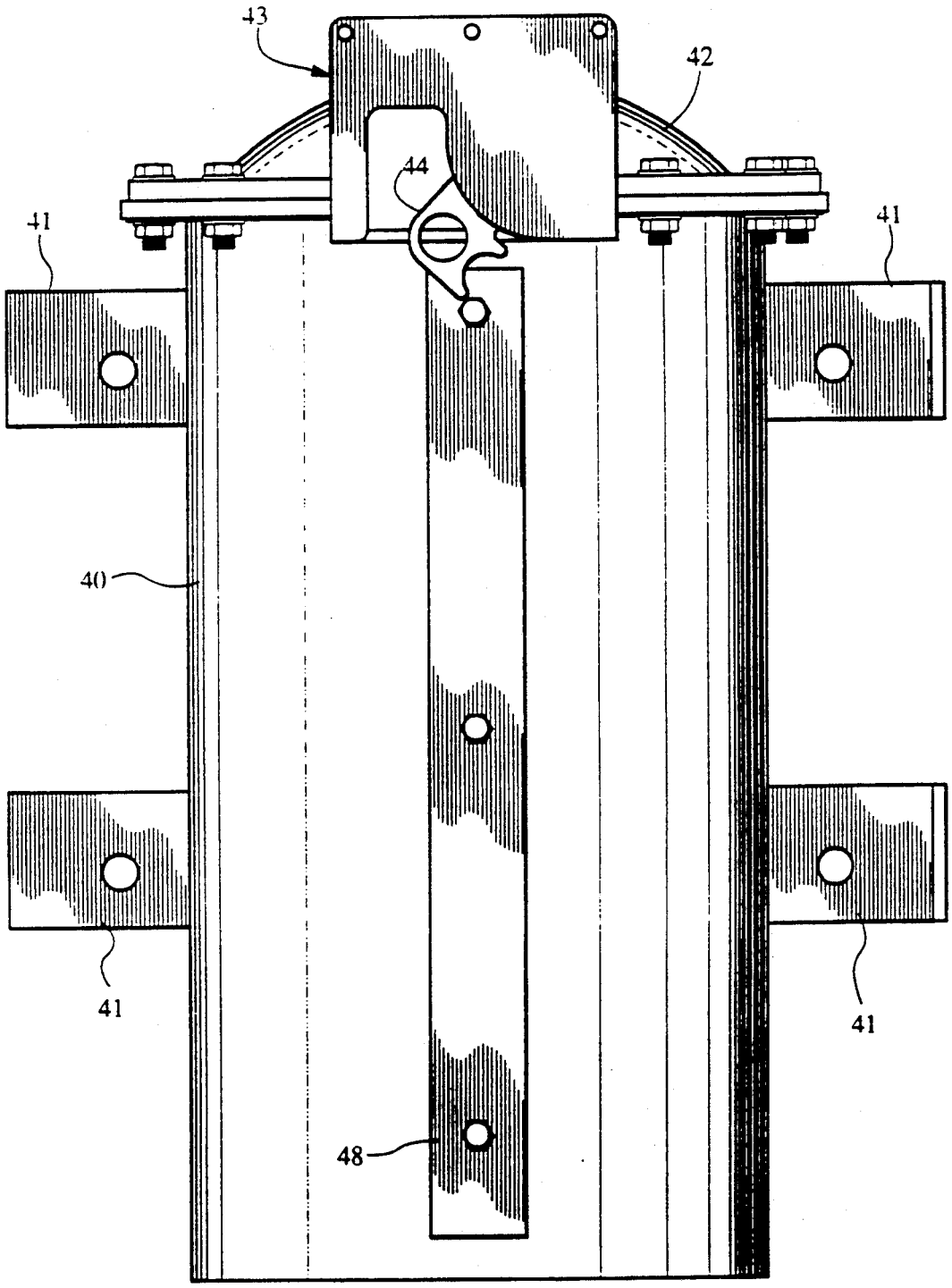
FIG. 1 is a side elevation view of a single-phase recloser constructed in accordance with the present invention.

A preferred embodiment of the recloser apparatus of the present invention is shown in the figures, and with reference to FIG. 1, the apparatus includes a housing or tank 40 having a set of mounting brackets 41 thereon by which the recloser may be mounted to a utility pole or the like. The tank 40 defines a sealed interior space which is preferably filled with an insulating gas such as $SF_6$ gas or the like, and which houses an interrupter assembly as described below. A cover 42 is attached to the tank 40 in sealing engagement therewith and is removable to permit access to the interrupter disposed within the interior space.

An operating assembly 43 is mounted on the upper front side of the tank 40 and includes an operating arm 44 that is accessible from outside the tank and is movable between an upper, intermediate and lower position, the operating arm being shown in the lower position in FIG. 1.

Figure 2:
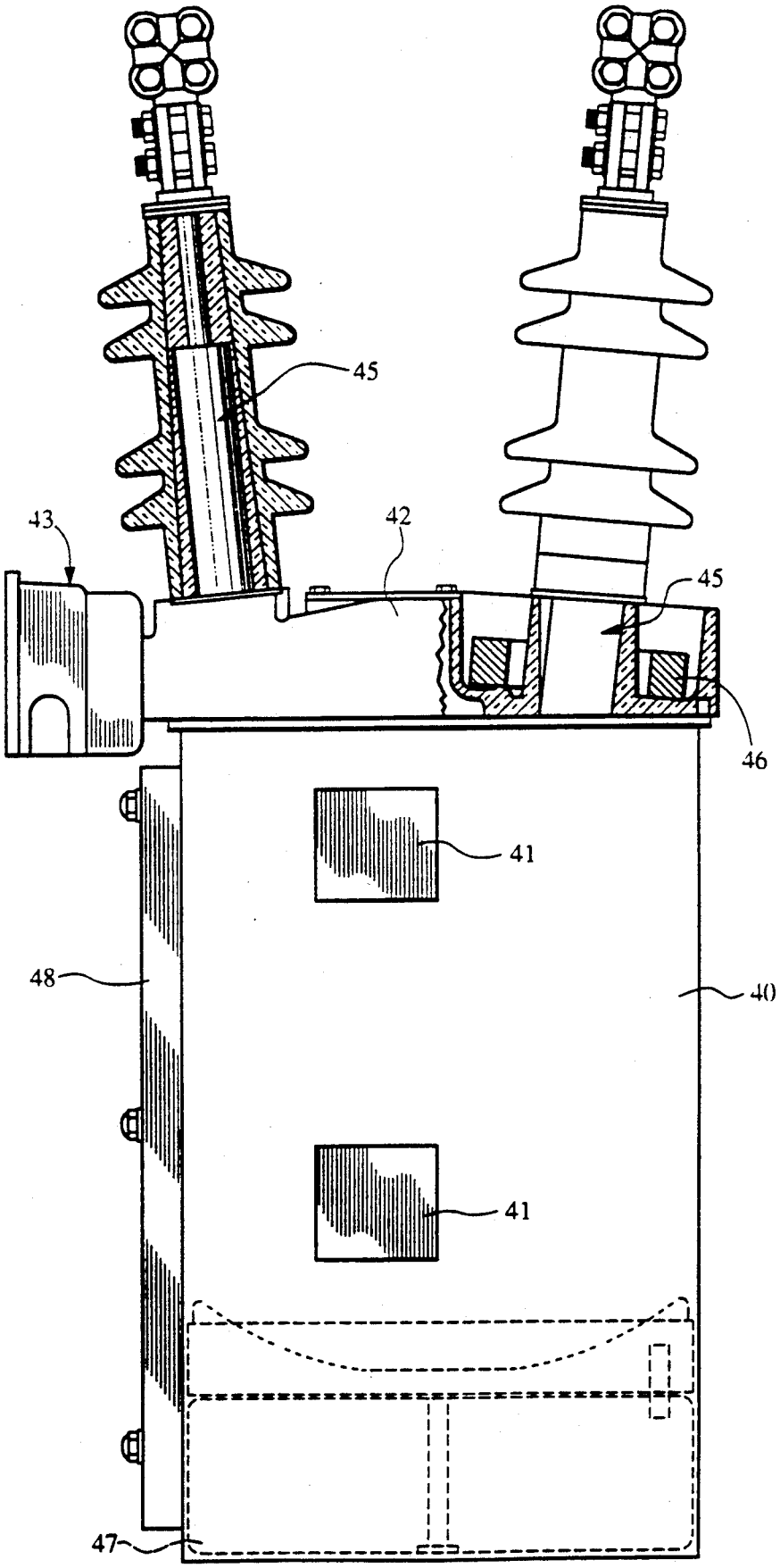
FIG. 2 is a schematic side elevation view, partially in section, of a recloser with bushings attached thereto.

Turning to FIG. 2, the recloser is illustrated from the side, with a pair of bushings 45 attached thereto and extending through the cover 42 into the interior space of the tank 40. As shown in the figure, a current transformer 46 is provided around one of the bushings 45 and serves as a current sensing means for sensing a fault current experienced by the recloser apparatus during operation. The sensing means 46 is electrically connected in a conventional manner with a control assembly 47 that is preferably mounted in the bottom of the tank beneath the sealed interior space in a manner consistent with the disclosure of copending U.S. Ser. No. 463,472, filed concurrently herewith by Eppinger and incorporated herein by this express reference thereto. A copy of the specification and drawing of the Eppinger application is submitted herewith as Appendix A. A wire channel 48 is provided on the side of the tank 40 for protecting the wires leading to the current transformer 46 as well as the wires connecting the control assembly with the operating assembly 43 and the interrupter assembly discussed below.

The control assembly 47 includes a control means incorporating conventional hardware such as a microprocessor, which is programmed to carry out the functional operations discussed more fully below. It is noted that the particular electronic control means used in a recloser constructed in accordance with the invention is not critical so long as the control means is capable of carrying out the control functions discussed more fully below with respect to the operation of the inventive recloser apparatus.

Figure 3:
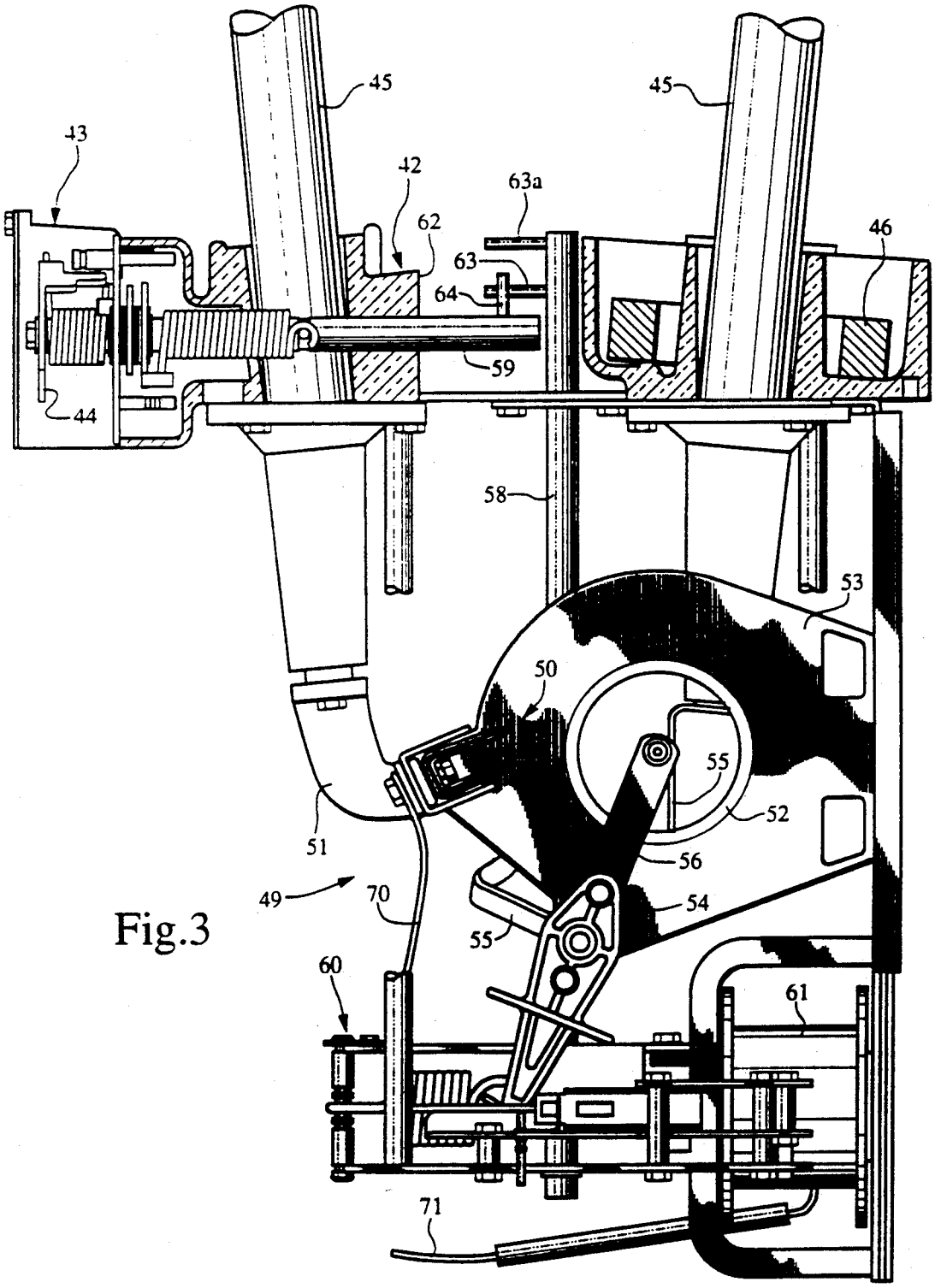
FIG. 3 is a side sectional view of the recloser illustrating the interrupter assembly.

The interrupter assembly is shown in FIG. 3 and preferably includes an arc-spinner interrupter of the t disclosed in copending U.S. Ser. No. 446,476, filed on Dec. 5, 1989, by Eppinger et al. The disclosure of the Eppinger et al. application is incorporated herein by reference, and a copy of the specification and drawing of this application is submitted herewith as Appendix B.

Figure 6:
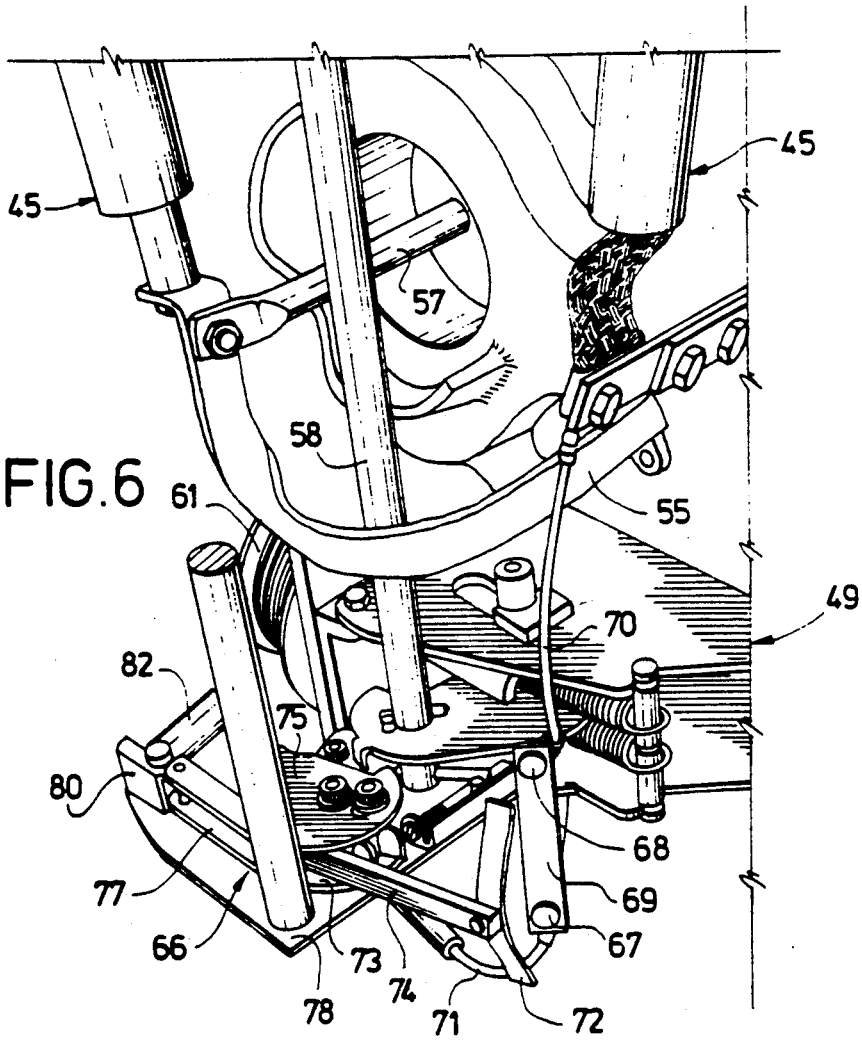
FIG. 6 is a perspective view of the interrupter assembly.

Briefly, the interrupter assembly 49 includes a fixed electrical contact 50 connected to one of the bushings 45 via a bus bar 51, and a ring electrode 52 coupled to the fixed contact 50 through a field coil (not shown) surrounding the ring electrode and mounted in an insulating support structure 53. A second electrical contact 54 connected with the other bushing through a bus bar 55 has an arm 56 which moves along a path perpendicular to the central longitudinal axis of the ring electrode 52 for selective connection with the fixed contact 50. The arm 56 may have a generally L-shaped configuration including an angled portion that extends in a direction into the figure and parallel to the central longitudinal axis of the ring electrode as viewed in FIG. 3. As shown in FIG. 6, a grading rod 57 extends toward the movable arm 56 through the ring electrode 52 along the central longitudinal axis and is also connected to the same bushing as the second contact 54 via the bus bar 55 extending between the bushing and the second contact.

The grading rod 57 has an inner axial end that is spaced slightly from the angled portion of the arm 56 when the arm is moved to a position intersecting the central longitudinal axis of the ring electrode so that a grading function is carried out on the electrostatic field surrounding the angled portion of the arm 56. Returning to FIG. 3, the fixed electrical contact 50 is disposed radially outward of the ring electrode 52 so that the generally L-shaped end of the second contact 54 moves generally toward the central longitudinal axis when disconnected from the fixed electrical contact 50.

During movement of the second contact 54 away from the fixed contact 50, electromagnetic forces are simultaneously exerted on the arc due to the general L-shape of the arm 56 of the second contact 54 and these forces move the arc material both toward the ring electrode 52 and in the direction in which the arc spins once it has commuted to the ring electrode. In addition, the insulating gas within the internal space also aids in extinguishing the arc before the movable arm 56 reaches the central position shown in FIG. 3.

Also illustrated in FIG. 3 is the external operating assembly 43 and an internal operating shaft 58 extending between an external operating shaft 59 of the assembly 43, and a main latching assembly 60. The main latching assembly retains the movable arm 56 of the second contact 54 in the closed, current-carrying position in engagement with the fixed contact 50 and releases the arm to be moved to the open current-interrupting position. The main latching assembly is discussed more fully below. A high-voltage solenoid coil 61 is also shown in FIG. 3, which forms a portion of a closing means also discussed below.

Figure 4:
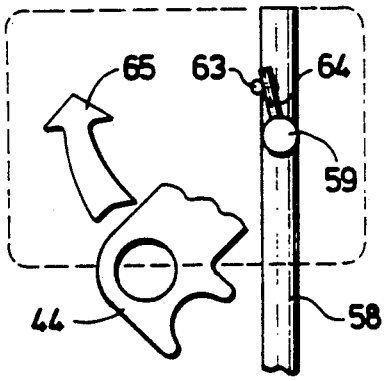
FIG. 4 is a schematic view of the operating arm and mechanical linkage between the arm and the internal operating shaft, as shown in the lockout position of the arm.

The external and internal operating shafts 59, 58 include axial ends disposed in an opening 62 of the cover, and each of the shafts is provided with a radially extending pin 64, 63, wherein the pin 64 provided on the external shaft 59 engages the pin 63 of the internal shaft 58 when the external shaft is rotated in the counterclockwise direction as shown in FIG. 4, away from the arrow 65. This rotation of the external shaft 59 coincides with movement of the operating arm 44 to the lower position as shown in the figure such that when the operating arm 44 is rotated to the lower position, movement of the external and internal shafts 59, 58 is carried out.

Figure 5:
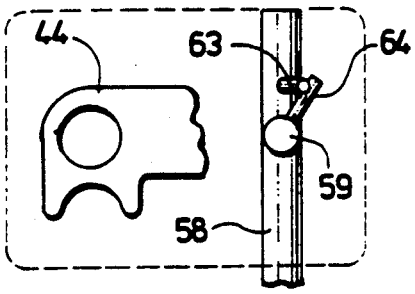
FIG. 5 is a schematic view similar to FIG. 4, with the arm shown in the closed, normal operating position.

When the operating arm 44 is moved in the direction of the arrow 65 to the intermediate position, as illustrated in FIG. 5, or to the upper position, the pin 64 of the external shaft 59 does not cause rotation of the internal shaft 58 and the internal shaft remains in the position shown in FIG. 5. Thus, the internal shaft serves as a slave link between the external operating assembly 43 and the interrupter assembly 49 such that the internal shaft 58 is always driven by the external shaft 59 and never functions to drive the shaft 59.

An auxiliary contact assembly 66 is shown in FIG. 6, which includes a pair of auxiliary contacts 67, 68 spaced from one another on an insulated mounting element 69. The upper auxiliary contact 68 includes a lead wire 70 extending to the fixed contact 50 of the interrupter assembly 49 and thus to the bushing 45, and the lower auxiliary contact 67 is connected via lead wire 71 to one end of the high voltage closing solenoid coil 61, with the opposite end of the coil 61 being grounded.

Figure 12:
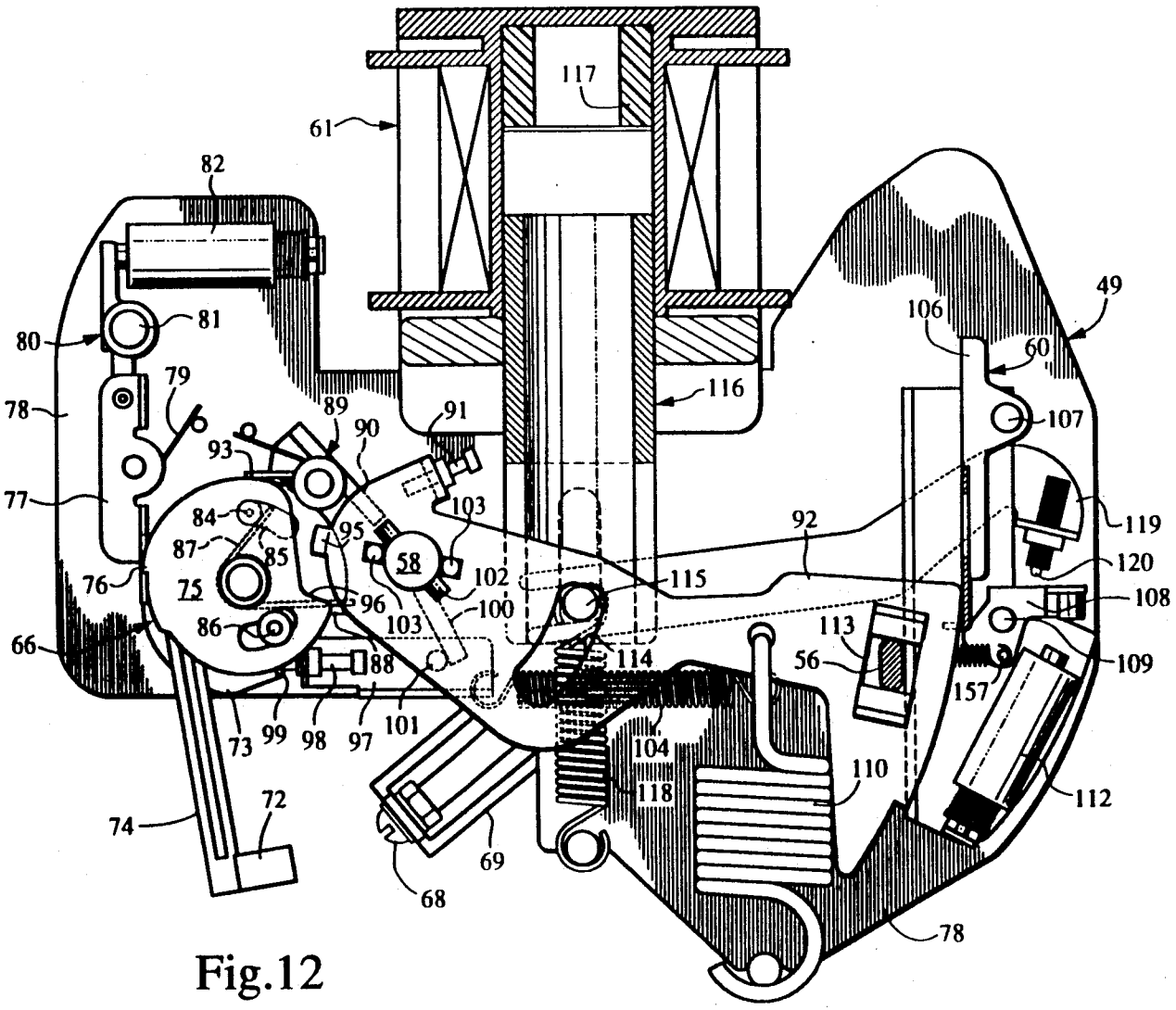
FIG. 12, is a schematic plan view of the internal mechanism of the recloser, with the main latch plate shown in the interrupter-open position.

The auxiliary contact assembly 66 also includes an elongated conductor 72 adapted to electrically connect the upper and lower auxiliary contacts 68, 67 when the high voltage closing solenoid coil 61 is to be energized so that current flows from the bushing 45 via the auxiliary contacts 68, 67 through the coil 61 to ground. As shown in FIG. 12, an auxiliary contact bottom latch plate 73 is connected to the conductor 72 by an insulated arm 74 which is secured to the upper surface of the bottom plate 73 for movement therewith.

The bottom plate is mounted for rotation about an axis coincident with the rotational axis of an auxiliary contact top latch plate 75, and the top latch plate includes a latching pawl 76 adapted to be normally retained on a mating surface of an auxiliary contact latch lever 77 except during actuation of the high voltage solenoid coil 61.

Figure 14:
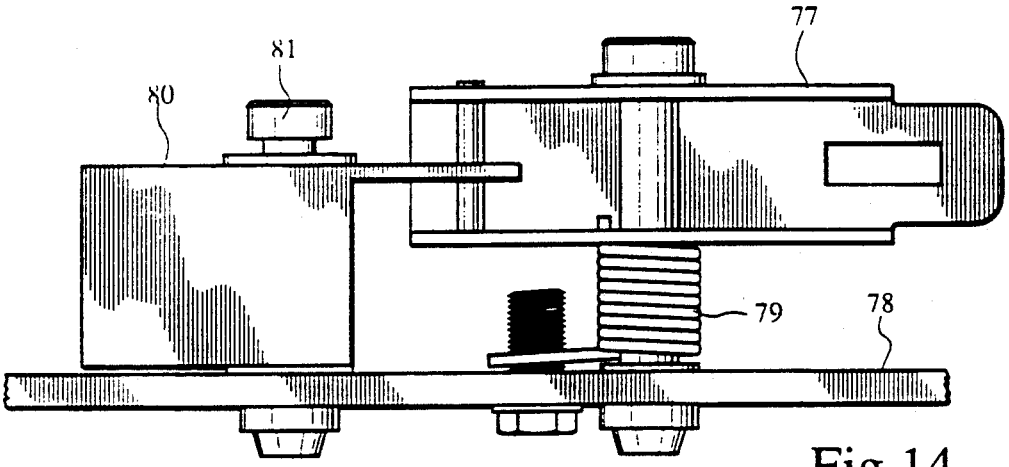
FIG. 14 is a side elevation view of the auxiliary contact latch lever and reversing lever.

The auxiliary contact latch lever 77 is pivotally supported on a base bracket 78 of the interrupter assembly 49 and is biased toward the latched position by a torsion spring 79 as illustrated in FIG. 14. A reversing lever 80 is pivotally supported at an end of the auxiliary latch lever 77 opposite the top latch plate 75, and is further pivotal about a support pin 81 located intermediate the latch lever 77 and a closing solenoid actuator 82.

Figure 13:
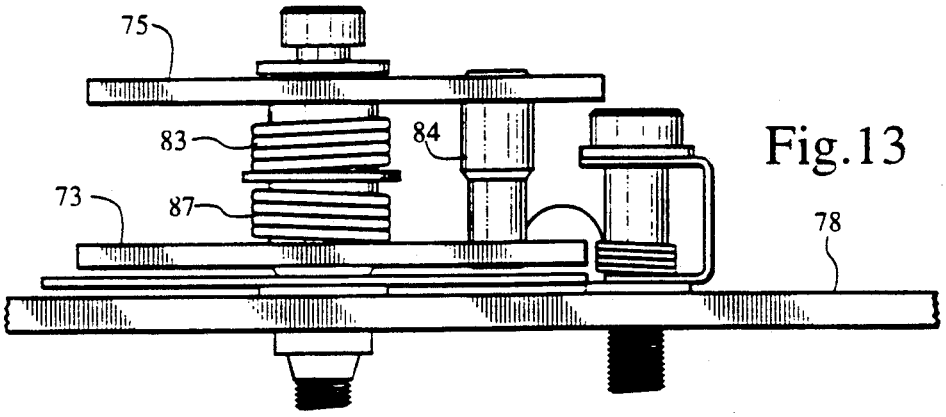
FIG. 13 is a side elevation view of the auxiliary contact assembly.

As shown in FIG. 12, the closing solenoid actuator 82 is also mounted on the bracket 78 and is operable to pivot the reversing lever 80 in the counterclockwise direction, thus causing clockwise rotation of the auxiliary latch lever 77 so that the top latch plate 75 is free to rotate in the counterclockwise direction under the bias of a torsion spring 83, shown in FIG. 13. The torsion spring 83 has one end abutting a first pin 84, illustrated in FIG. 12, which is fixed to the top latch plate 75 and extends through a slot 85 in the bottom plate 73, and another end abutting a second pin 86 attached to the bracket 78 and extending through the top plate 75 and past the bottom plate 73.

A second torsion spring 87 is also provided between the top and bottom auxiliary contact latch plates, as shown in FIG. 12, and functions to bias the bottom plate 73 in the clockwise direction relative to the top plate 75 such that the bottom plate tends to follow the top plate when the top plate is rotated in the clockwise direction. The second torsion spring 87 includes a first end engaging the first pin 84 and a second end engaging an upstanding tab 88 of the bottom plate 73.

An auxiliary contact reset means includes a secondary latch lever 89 which is spring biased in a counterclockwise direction and which includes an arm 90 that is contacted by a set screw 91 on a main latch plate 92 during counterclockwise rotation of the main latch plate 92 during an interrupter closing operation. When the set screw 91 contacts the secondary latch lever 89, the lever is pushed in the clockwise direction so that a finger 93 provided on the lever is lifted from engagement with a pawl 94 formed in the auxiliary contact bottom latch plate 73. The reset means also includes a down-turned tab 95 of the main latch plate 92 which is adapted to engage a cam surface 96 of the auxiliary contact top latch plate 75 during counterclockwise rotation of the main latch plate 92.

Figure 15:
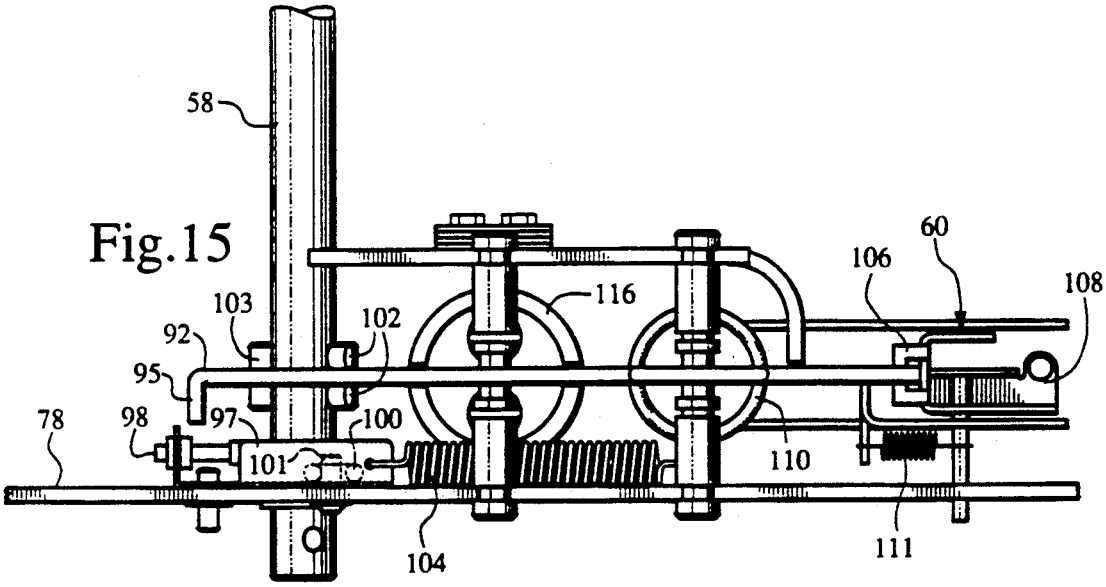
FIG. 15 is a front elevation view of the main latch plate and the elements supporting the latch plate within the apparatus.
Figure 23:
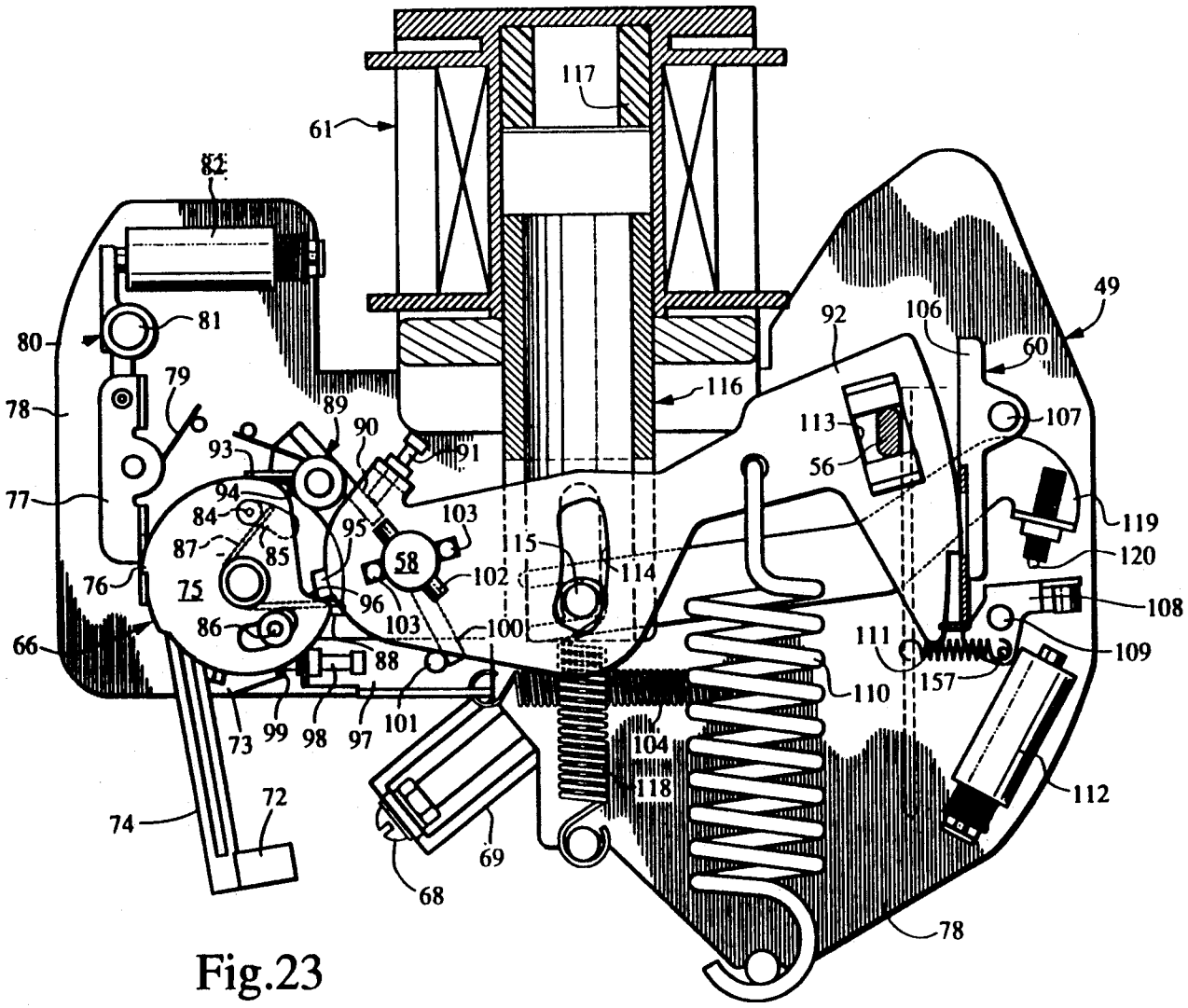
FIG. 23 is a view similar to FIG. 12, with the latch plate shown in the closed position just prior to release of the latch plate by the main latching assembly.

A lockout bracket 97, illustrated in FIG. 15, is mounted for sliding movement on the bracket 78 of the interrupter assembly 49 and includes an axially adjustable screw 98 adapted to engage an upstanding tab 99 of the auxiliary contact bottom latch plate 73 and prevent the bottom latch plate from rotating in the counterclockwise direction when the lockout bracket 97 is in the position shown in FIG. 23. The lockout bracket 97 is spring biased toward the position shown in FIG. 12 so as to normally permit free rotation of the auxiliary contact bottom latch plate 73.

The internal operating shaft 58 extends through the main latch plate 92 and is provided with a radially extending finger 100 that is adapted to engage an upstanding finger 101 of the lockout bracket 97 when the internal operating shaft 58 is rotated in the clockwise direction as shown in FIG. 23. In addition, the spring 104 which biases the lockout bracket away from the bottom latch plate 73 also serves to bias the internal shaft in the counterclockwise direction.

Figure 26:
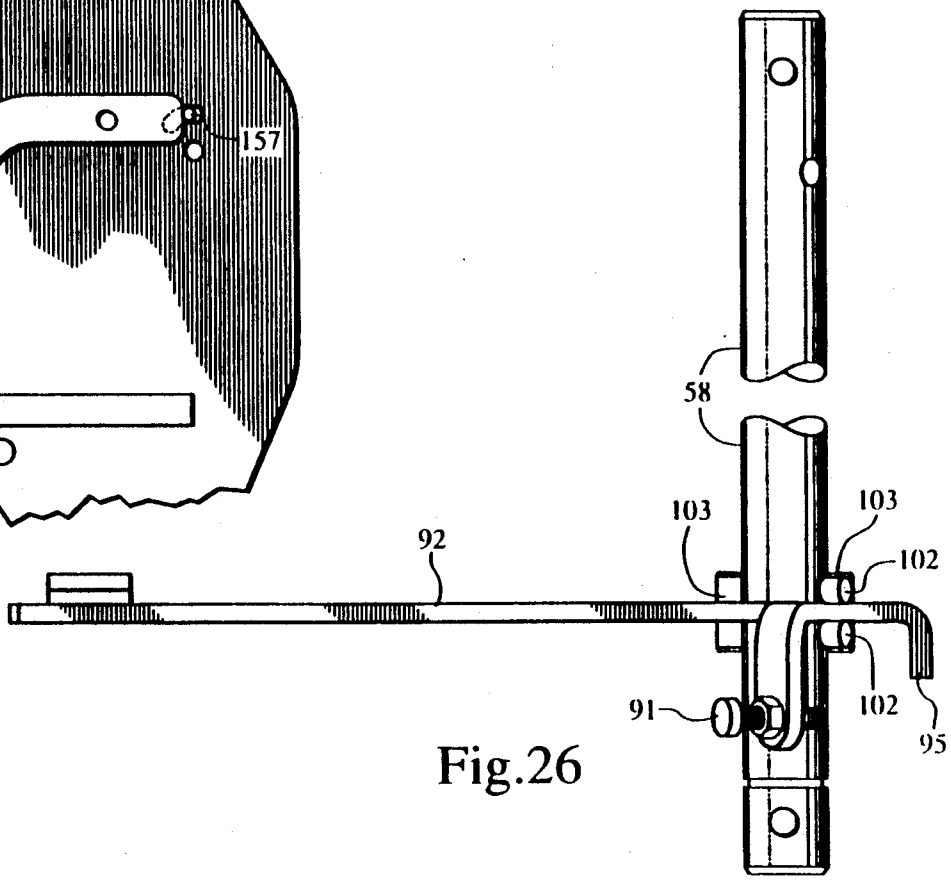
FIG. 26 is a side elevation view of the latch plate showing the mounting arrangement between the plate and the internal operating shaft.

As shown in FIG. 26, the main latch plate 92 is rotatably supported on the internal operating shaft 58 by a pair of vertically separated pins 102 extending through the shaft and locating the latch plate 92 therebetween. In addition, two vertically extending pins 103 are provided on the latch plate 92 for maintaining the orientation of the latch plate relative to the shaft 58 during relative rotation between the plate and the shaft.

As viewed in FIG. 23, the pins 102 are separated from the pins 103 in the circumferential direction of the internal shaft 58 by a distance sufficient to permit freedom of movement of the main latch plate 92 between the latched and unlatched positions. Thus, during fault induced operation of the interrupter, as described below, the internal shaft remains stationary. However, if the main latch plate 92 is in the unlatched position, as shown in FIG. 12, it is possible to move the latch plate 92 into the latched position by rotating the internal shaft in the counterclockwise direction so that the pins 102 engage the pins 103 and force the main latch plate 92 to follow the movement of the shaft 58.

Thus, a means is provided for closing the contact 50, 54 of the interrupter assembly 49 when no source of electricity is available to power the high voltage solenoid coil 61 which is normally used to close the contacts 50, 54. Although the tool used to rotate the internal shaft 58 is not shown in the drawing, the shaft 58 is illustrated in FIG. 3, as including an uppermost radial pin 63*a* that is accessible from outside the cover and which may be engaged to permit rotation of the shaft 58. Any conventional means can be used to engage the pin 63*a* and rotate the shaft 58.

The main latching assembly 60 is shown in FIG. 12 and includes the main latch plate 92 which is pivotally supported for rotation about the internal operating shaft 58 and which is biased by an opening spring 110 toward the interrupter-open position shown in FIG. 12.

Figure 22:
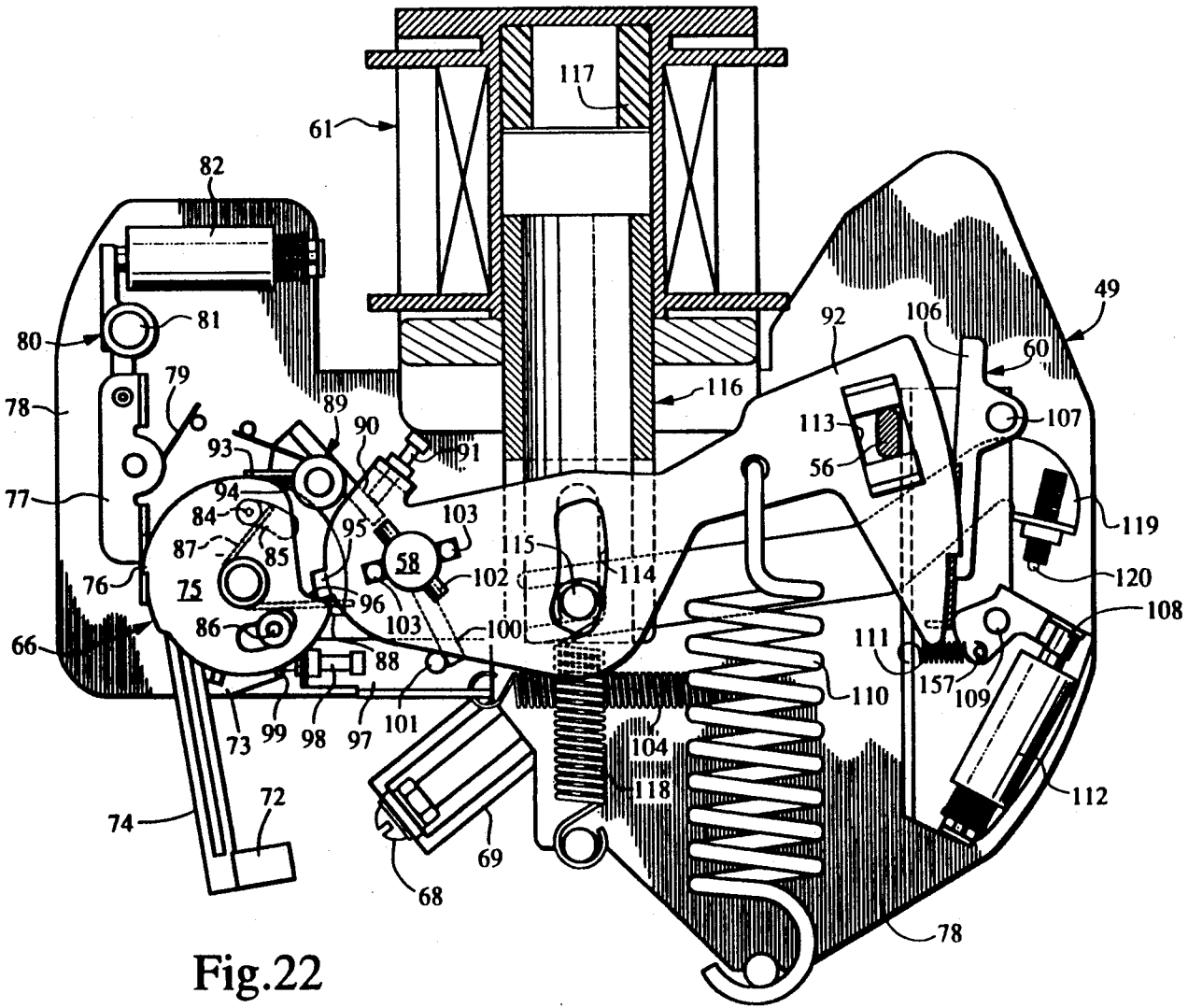
FIG. 22 is a view similar to FIG. 12, with the latch plate shown in the closed position after retraction of the solenoid plunger.

The main latch plate 92 includes a latch surface 105 on one edge thereof which is adapted to engage a mating surface on a primary latch lever 106 pivotally supported on the interrupter bracket by a pin 107. A secondary latch lever 108 is disposed adjacent the primary latch lever 106 and is pivotally supported by a pin 109 such that the secondary lever 108 is movable into and out of engagement with a rear surface of the latch lever 106 opposite the latch plate 92. As shown in FIG. 22, the secondary lever 108 is biased by a spring 111 toward a latched position in engagement with the primary lever as shown in the figure. An open solenoid actuator 112 is fixed to the interrupter base bracket 78 adjacent the secondary latch lever 108 and is operable to move the secondary lever against the bias of the spring 111 into a trip position out of engagement with the primary latch lever 106 such that the primary latch lever is free to move away from the main latch plate 92 under moment forces exerted on the primary lever 106 by the load of the latch plate and the open spring 110, and the latch plate is released and permitted to be moved to the interrupter open position under the force of the open spring.

An opening 113 is formed in the latch plate 92 adjacent the edge thereof which accommodates a lower end of the movable arm 56 of the second contact 54 of the interrupter assembly. The opening 113 is oversized relative to the end of the arm 56 so that the horizontal, pivotal movement of the latch plate 92 is transmitted to the vertical pivotal movement of the arm 56. An arcuate slot 114 is also provided in the latch plate 92 at a position intermediate the ends thereof and a plunger 116 is disposed beneath the main latch plate in line with the arcuate slot so that a vertical pin 115 provided on a plunger 116 engages the latch plate during movement of the plunger 116 relative to the high voltage solenoid coil 61. The plunger 116 is aligned with the central longitudinal axis of the coil 61 for movement into the coil toward a stop 117 when the coil is energized. However, the slot 114 is dimensioned to permit return movement of the plunger 116 to a position retracted from the coil 61 after actuation of the coil and latching of the latch plate 92 by the primary latch lever 106.

By providing for this relative movement between the latch plate 92 and the plunger 116, it is possible to use the plunger to move the latch plate into the interrupter-closed position and to load the open spring 110, and then to move the plunger 116 back to the retracted position out of the way of the latch lever such that it is not necessary for the open spring 110 to move the mass of the plunger during a subsequent interruption operation. The return of the plunger 116 is carried out instead by a pair of plunger springs 118 connected between the interrupter bracket 78 and the vertical pin 115 of the plunger 116.

Figure 20:
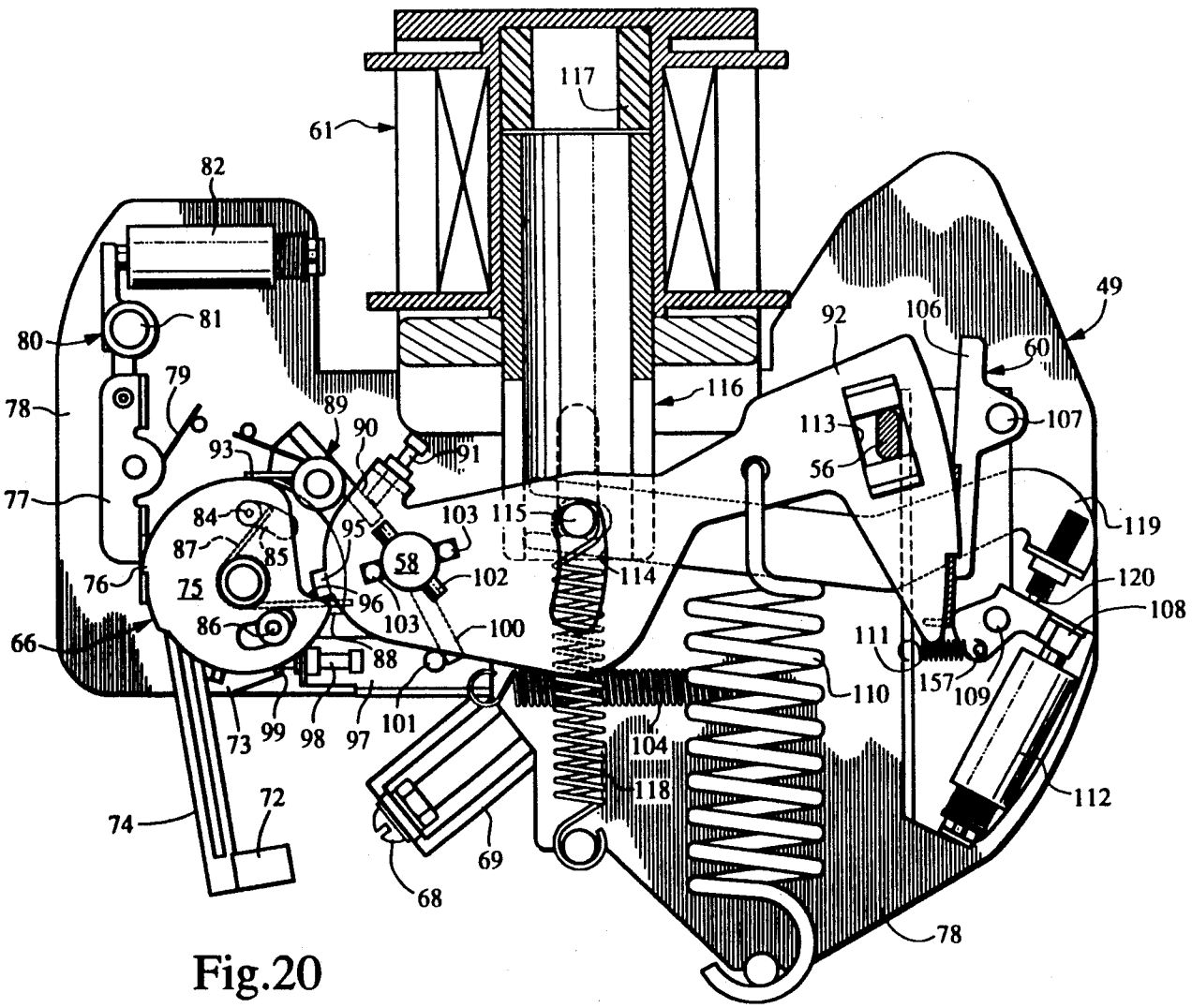
FIG. 20 is a view similar to FIG. 12, with the latch plate shown in the closed position prior to retraction of the solenoid plunger.

A reset lever 119 is provided as a part of the main latching assembly 60 and is pivotally supported on the interrupter bracket 78 at a point intermediate the ends of the reset lever such that the lever pivots between a retracted position as illustrated in FIG. 12 and an engagement position as illustrated in FIG. 20. A spring plunger 120 is provided at the end of the reset lever 119 adjacent the secondary latch lever 108 and engages the secondary latch lever when the reset lever 119 is in the engagement position of FIG. 20. The spring plunger 120 functions to hold the secondary latch lever 108 in place relative to the primary latch lever 106 during the impact of the plunger 116 within the high voltage solenoid coil 61 so that the main latch plate 92 will not be inadvertently unlatched due to the mechanical shock of the plunger 116 impacting against a stop 117 within the coil 61.

The end of the reset lever 119 opposite the spring plunger 120 is split and fits around the vertical pin 115 provided on the plunger 116 so that the spring plunger 120 engages the secondary latch lever 108 when the plunger 116 is in a position adjacent the stop 117, and moves away from the secondary latch lever when the plunger is withdrawn from the coil 61.

Figure 7:
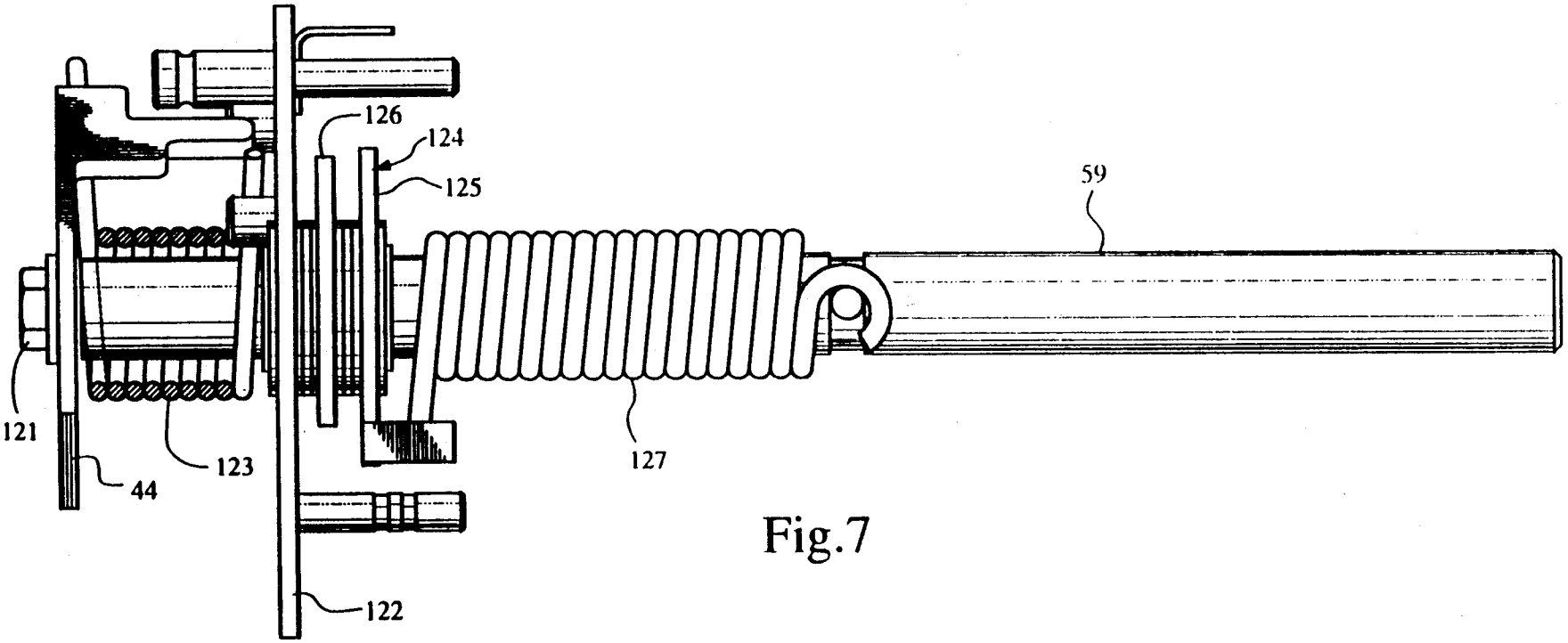
FIG. 7 is a side elevation view of the operating arm of the external operating assembly.

The external shaft 59 and operating arm 44 of the external operating assembly 43 is shown in FIG. 7, wherein the arm is illustrated as being secured for rotation with the shaft by a bolt 121, and a mounting plate 122 is provided through which the shaft 59 extends. A torsion spring 123 extends between the arm 44 and the mounting plate 122 for biasing the shaft 59 in the counterclockwise direction relative to the mounting plate 122 such that arm 44 is biased toward the lower position thereof. An external latch plate assembly 124 is also provided on the shaft 59 and includes an external latch plate 25 rotatably supported on the shaft 59, a link plate 126 secured to the shaft and spaced from the latch plate 125 by spacing washers, and a torsion spring 127 which biases the latch plate in the counterclockwise direction relative to the shaft 59 when viewed from the front of the external operating assembly 43.

Figure 9:
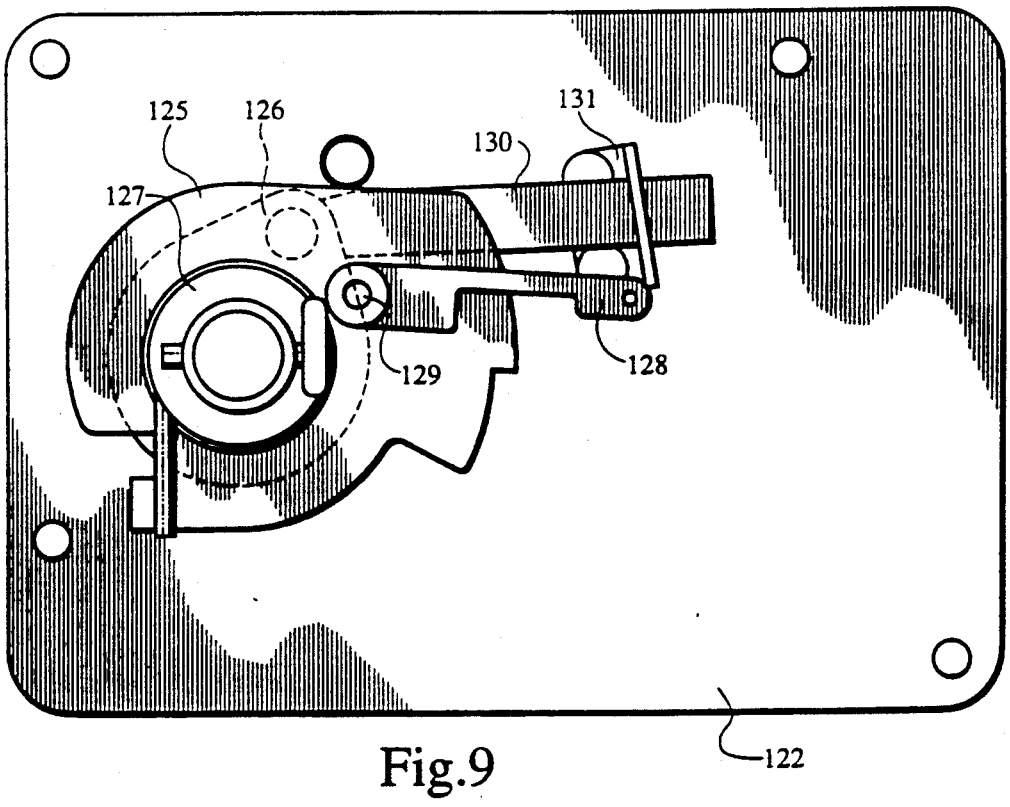
FIG. 9 is a rear elevation view of the operating arm of FIG. 7.

Turning to FIG. 9, the latch plate 125 is provided with a pawl 128 thereon which is pivotal relative to the plate about mounting pin 129 and which functions in a manner described more fully below. The link plate 126 includes an arm 130 pivotally supported thereon which extends through a guide bracket 131 secured to the mounting plate 122.

Figure 17:
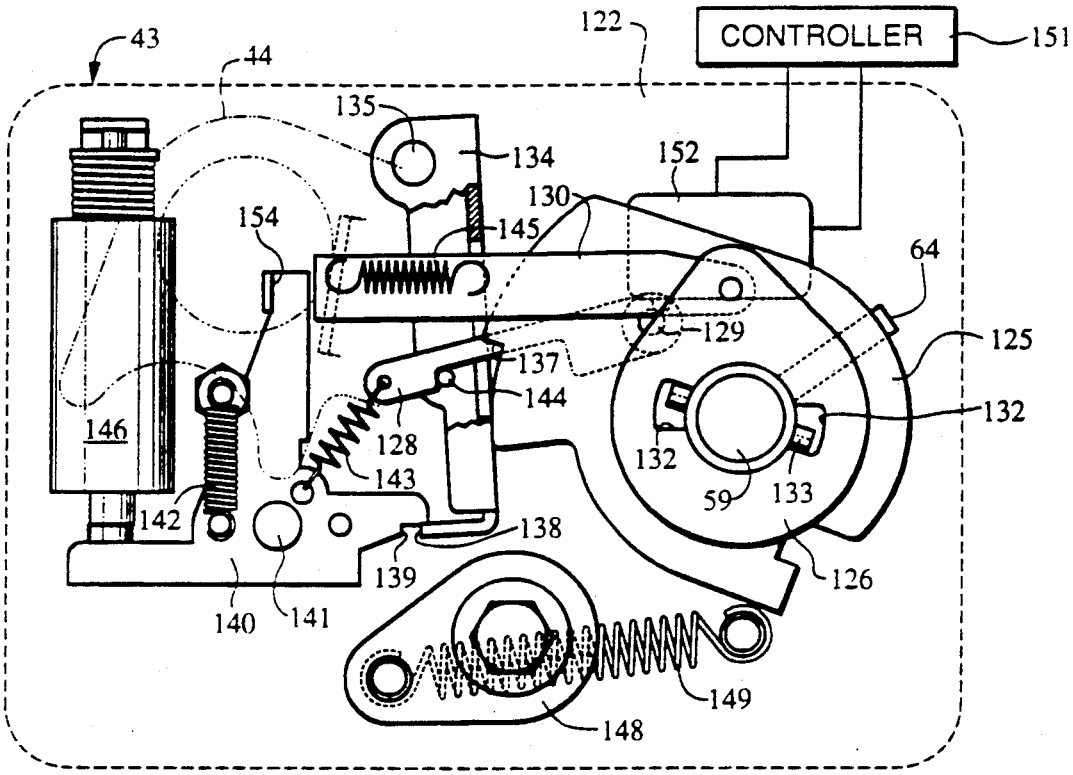
FIG. 17 is a schematic view of the external operating assembly viewed from the front of the assembly and looking past the operating arm and through the support plate of the assembly, with the support plate and operating arm shown in phantom, the operating arm being shown moving toward the contact closing position.

As illustrated in FIG. 17, the external latch plate includes a central opening provided with two arcuate, radially extending slots 132. The opening is sized to permit relative movement between the latch plate 125 and the operating shaft 59, and the two slots 132 are adapted to receive the ends of a transverse pin 133 extending through the shaft 59 and to permit a limited range of freedom of movement of the shaft 59 relative to the latch plate 125. The link plate 126 is secured to the operating shaft so that when the shaft is rotated, the link plate also rotates, regardless of the position of the latch plate 125.

As also shown in FIG. 17, a latch lever 134 is provided in the external operating assembly 43 which is pivotally mounted for rotation about a pin 135 and which includes a first latch surface 136 adapted to mate with a corresponding latch surface 137 provided on the latch plate 125, and a second latch surface 138 adapted to mate with a corresponding latch surface 139 of a secondary latch lever 140.

The secondary latch lever 140 is pivotally supported for rotation about a pin 141 and is biased toward the position shown in FIG. 17, by a spring 142. A further spring 143 on the secondary latch lever 140 biases the pawl 128 of the latch plate 125 downward against a pin 144 provided on the latch lever 134. The latch lever 134 is biased in the clockwise direction as shown in FIG. 17, by a spring 145. A solenoid actuator 146 is mounted to the mounting plate 122 and includes a plunger adapted to rotate the secondary latch lever 140 in the counterclockwise direction in order to release the latch lever 134 and the latch plate 125 as shown, e.g. in FIG. 28. The operation of the assembly is discussed more fully below.

A one-shot-to-lockout lever 147 is also provided in the external operating assembly 43 as shown in FIG. 10, and is connected to a biasing plate 148, illustrated in FIG. 32, that is biased by a spring 149 toward either an actuated or non-actuated position. A one-shot-to-lockout contact switch 150 is mounted within the operating assembly 43 adjacent the biasing plate 148 of the one-shot-to-lockout lever 147 and is contacted by the plate 148 when the lever is rotated to the actuated position. The contact switch 150 is in turn connected to the control means 151 so that the position of the lever 147 is sensed by the control means.

Figure 18:
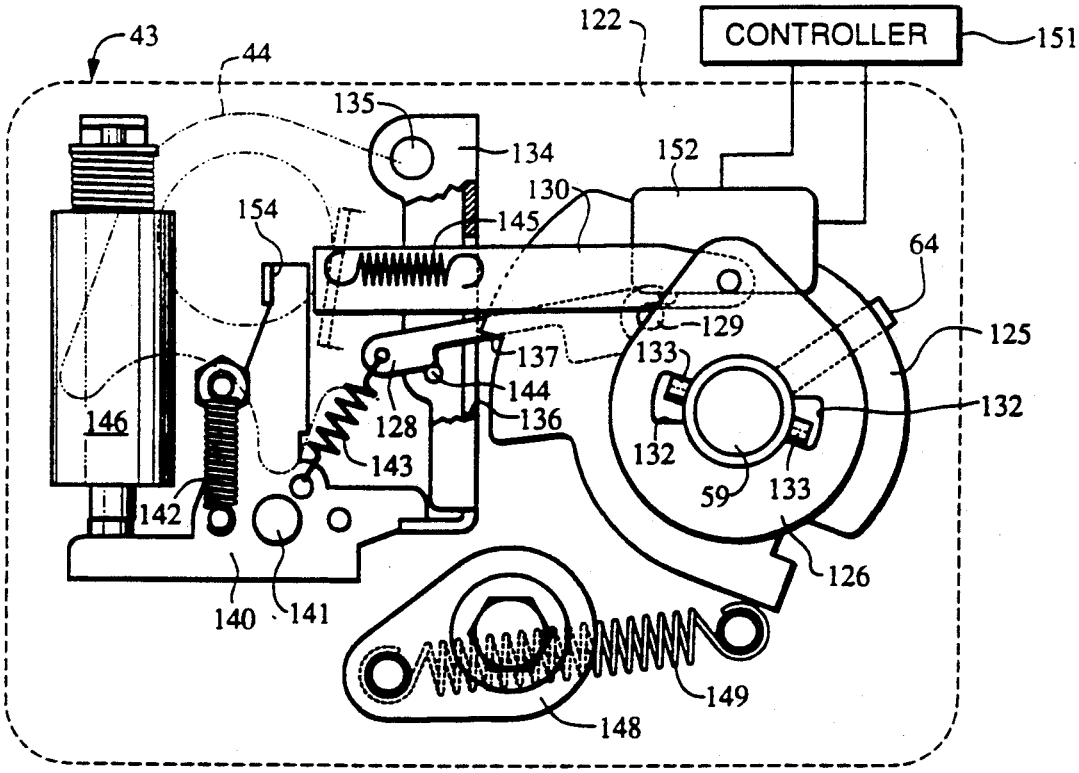
FIG. 18 is a view similar to FIG. 17, with the operating arm shown in the contact closing position.

A manual close contact switch 152 is located within the assembly 43 adjacent the latch plate 125 such that the pin 129 supporting the pawl on the latch plate closes the switch 152 when the latch plate 125 is rotated in a clockwise direction, as viewed from the front of the assembly, to the position shown in FIG. 18. This manual close contact switch 152 is also connected to the control means 151 in order to deliver a manual close signal to the control means when the arm 44 is moved to the position shown in FIG. 18.

Having thus described the construction of the apparatus, the operation thereof will now be discussed.

RECLOSER SETUP AND MANUAL CLOSING

Figure 16:
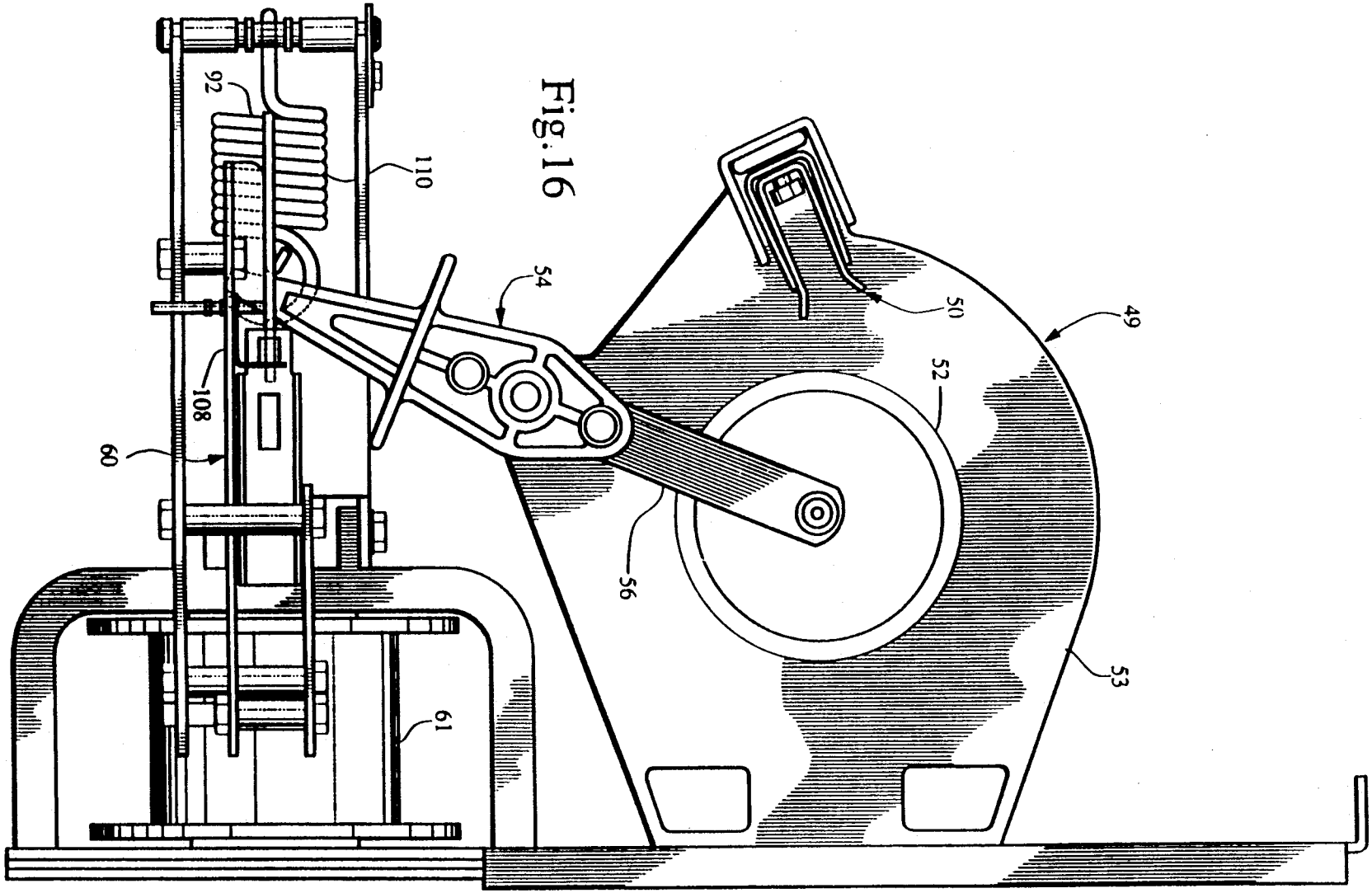
FIG. 16 is a front elevation view of the interrupter and the main latching assembly, with the interrupter shown in the open position.
Figure 28:
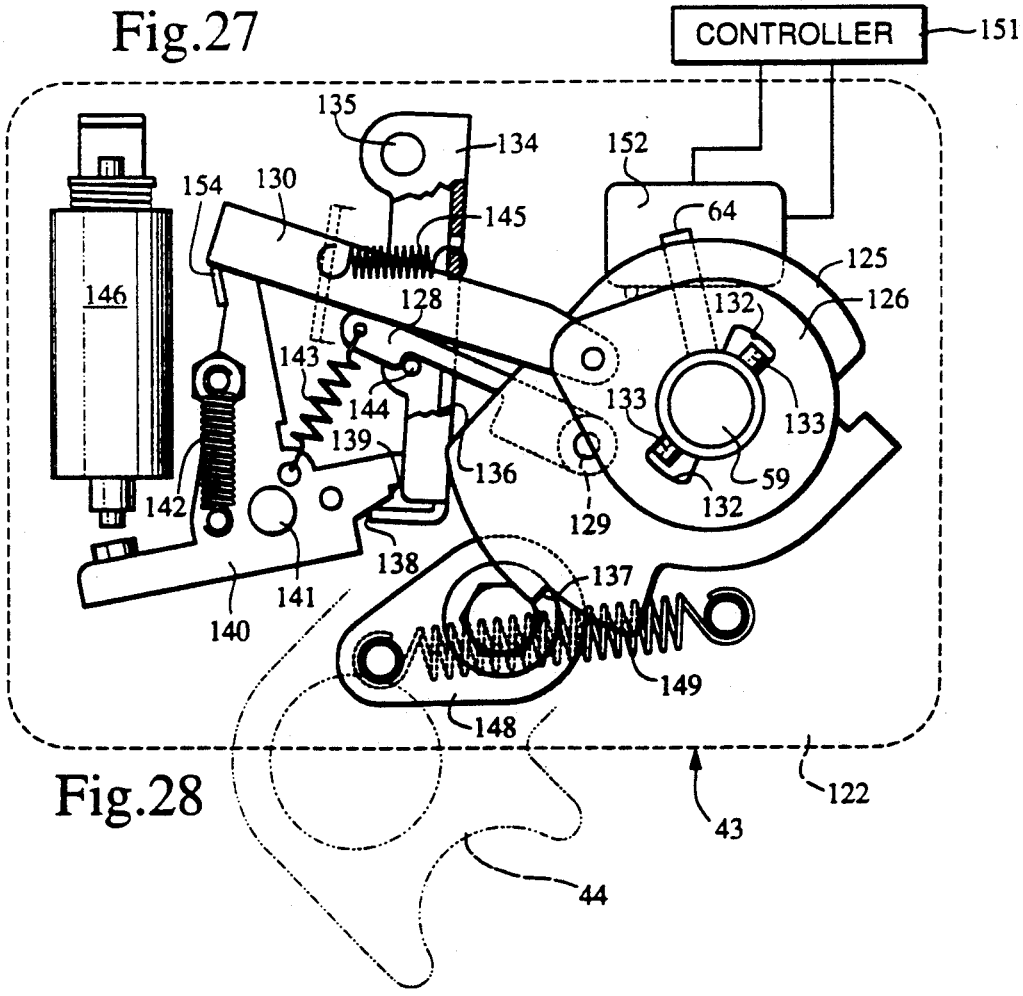
FIG. 28 is a view similar to FIG. 17, with the operating arm shown in the lockout position.
Figure 29:
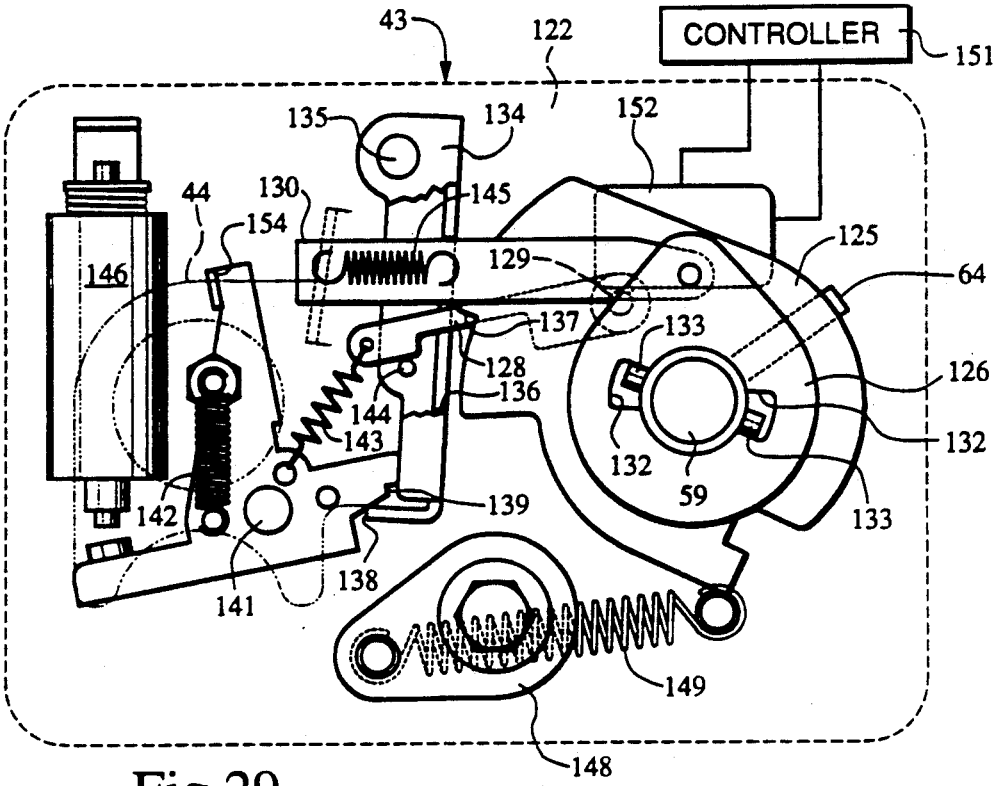
FIG. 29 is a view similar to FIG. 17, with the operating arm shown moving toward the contact closing position and with the operating assembly shown in the tripped position.

During initial installation of the recloser apparatus of the preferred embodiment, the interrupter contacts 50, 54 are open as shown in FIG. 16, with the movable arm 56 of the second contact 54 in a position out of engagement with the fixed contact 50. In addition, the operating arm 44 of the external operating assembly 43 is in the lower, lockout position as shown in FIGS. 10 and 28, such that the radial pin 64 of the external operating shaft 59 has engaged the pin 63 fastened to the internal operating shaft 58 and caused rotation of the internal shaft to the position shown in FIG. 23. In this position of the shaft 58, the lower radially extending finger 100 of the internal shaft has engaged the upstanding pin 101 of the lockout bracket 97 and moved the bracket into the lockout position shown, wherein the bracket engages the tab 99 of the auxiliary contact bottom latch plate 73. When in the lockout position, the lockout bracket 97 prevents rotation of the bottom auxiliary latch plate 73 in the counterclockwise direction.

Once the recloser apparatus has been installed and connected to a distribution system and is ready for use, the operating arm 44 is manually moved to the upper position shown in FIG. 18. As shown in FIG. 17, during movement of the arm 44 toward the upper position, the pawl 128 engages the pin 144 of the primary latch lever 134 and pulls the lever a slight distance beyond the latch surface 139 of the secondary latch lever 140 so that the primary latch lever 134 will latch with the secondary lever 140 upon release of the primary lever during continued upward movement of the arm 44. In addition, the latch plate 125 is rotated in the clockwise direction so that the latch surface 137 of the latch plate moves to a position above the cooperating latch surface 136 of the lever 134 and the pawl 128 moves toward the contact switch 152.

Figure 11:
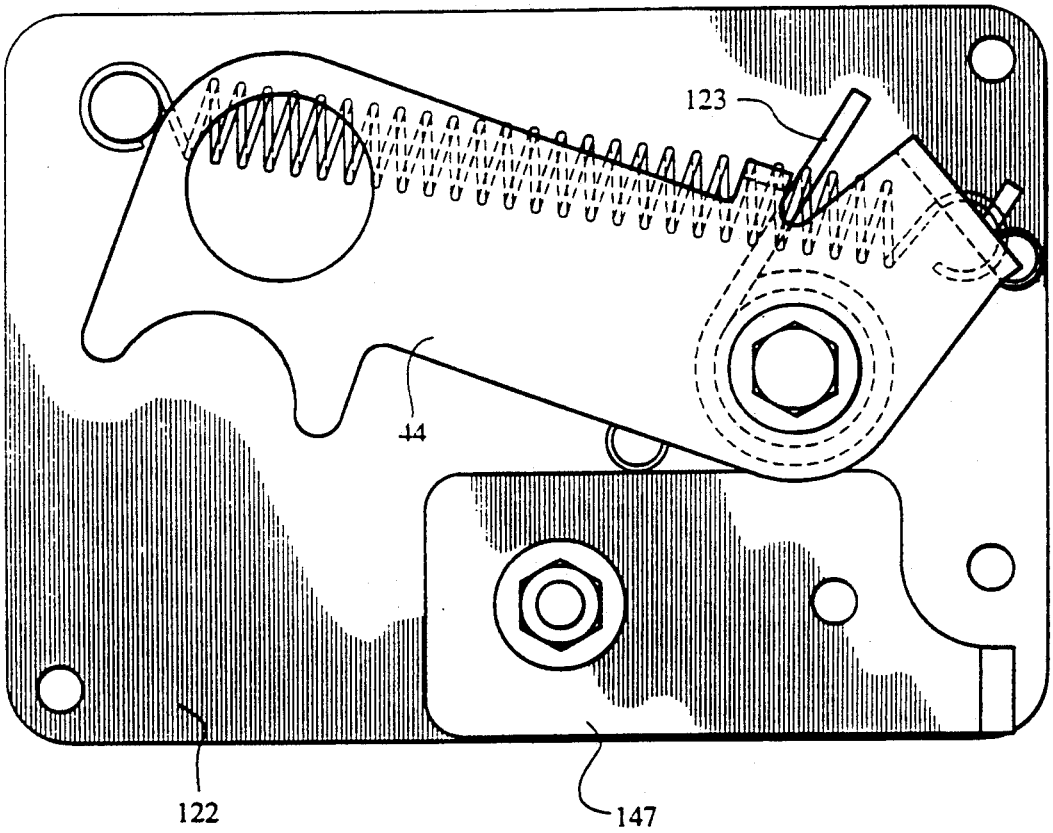
FIG. 11 is a front elevation view similar to FIG. 10, with the operating arm shown in the contact closing position.

Upon continued movement of the arm 44 toward the position shown in FIGS. 11 and 18, the pin 129 supporting the pawl 128 on the latch plate 124 engages the contact of the switch 152, as illustrated in FIG. 18, and causes a signal to be sent to the control means 151 in the assembly 47 at the bottom of the tank 40 indicating that manual closing has been initiated. The pawl 128 at the same time rides up and over the pin 144 of the primary lever 134 and the lever moves into a latched position in engagement with the secondary lever 140. Thereafter, when the arm 44 is released, the arm moves under action of the spring 123 to the intermediate position shown in FIG. 27, and the latch plate 125 settles into engagement with the latch surface of the primary lever 134.

Figure 19:
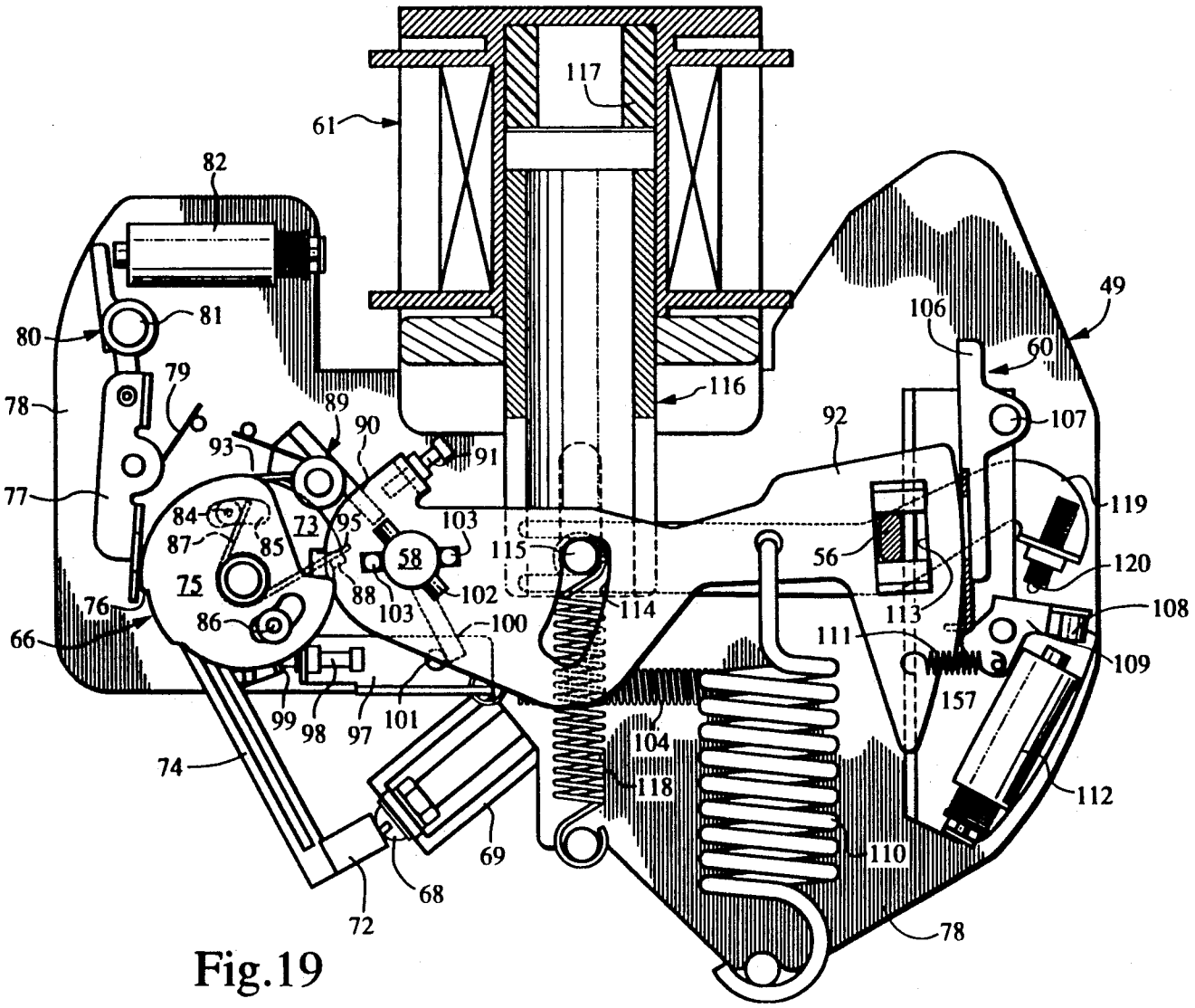
FIG. 19 is a view similar to FIG. 12, with the latch plate shown moving toward the closed position.

Once the control means 151 has received the close signal from the external operating assembly 43, an actuating pulse is delivered by the control means to the close solenoid actuator 82 and the actuator operates to move the reversing lever 80 to the position shown in FIG. 19. Rotation of the reversing lever 80 causes rotation of the auxiliary contact latch lever 77 in a direction opposite to the direction of rotation of the reversing lever 80 such that the auxiliary contact top latch plate 75 is released from engagement with the lever 77 and rotates under the bias of the torsion spring 83, shown in FIG. 13, to a contact-closed position. When the top plate moves to this position, the conductor 72 supported on the bottom latch plate 73 is moved into contact with the two separated contacts 7, 68 so as to close the circuit from the source side bushing 45 through the coil 61 to ground providing current to the high voltage solenoid coil 61.

Figure 24:
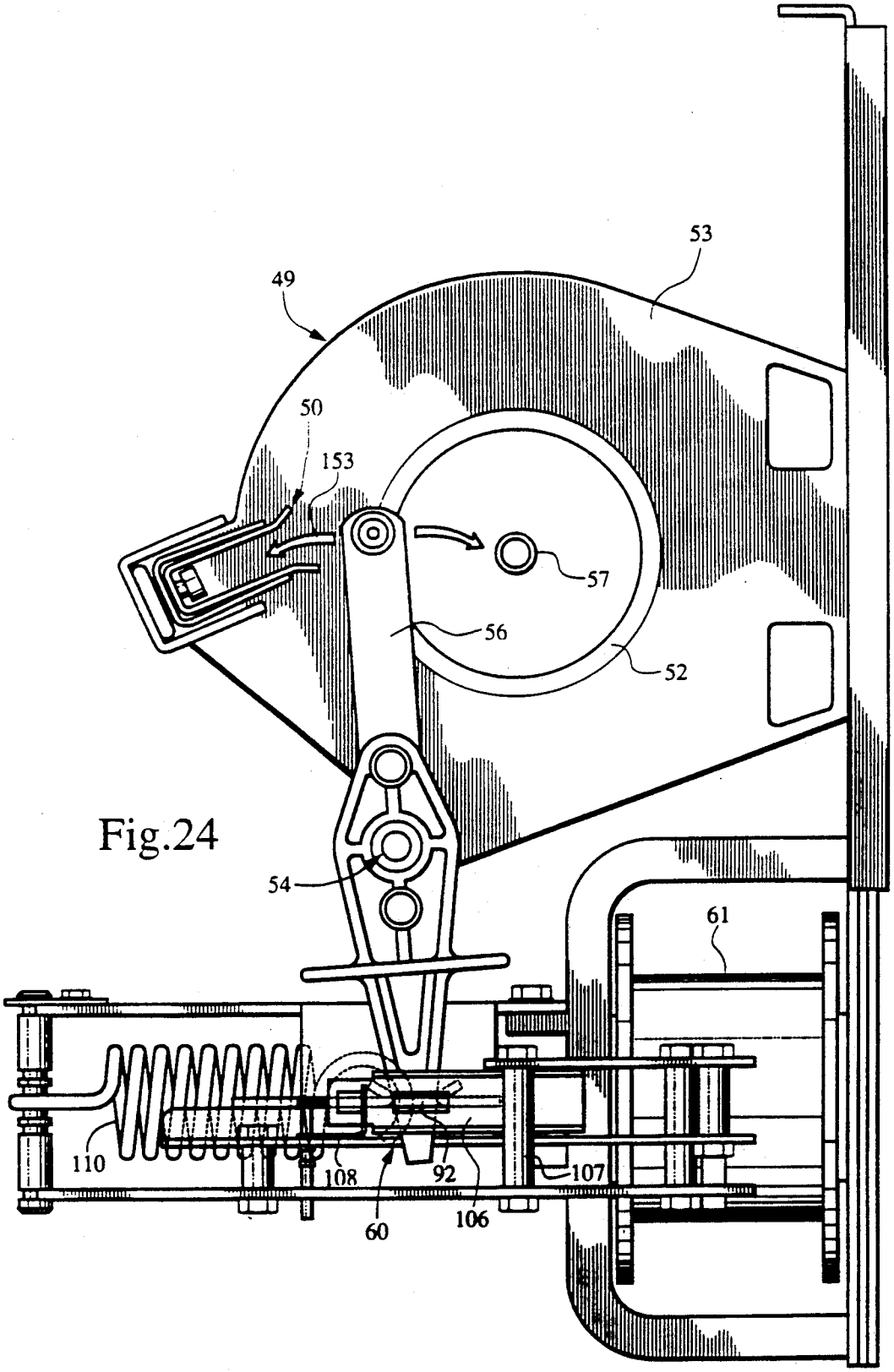
FIG. 24 is a view similar to FIG. 16, with the interrupter shown in a position intermediate the open and closed position.

As current flows through the coil 61, the plunger 116 is drawn into the coil and pulls along with it the main latch plate 92. At the same time, the plunger springs 118 and the opening spring 110 are loaded. As shown in FIG. 24, the movement of the main latch plate 92 causes movement of the movable arm 56 of the second contact 54 toward the fixed contact 50 as illustrated by the arrow 153. Also, returning to FIG. 19, the reset lever 119 supporting the spring plunger 120 is pivoted to present the spring plunger to the secondary latch plate 108. The movement of the main latch plate 92 also causes the tab 95 to engage cam surface 96 and rotate the auxiliary contact top latch plate 75 in the clockwise direction.

The auxiliary contact bottom latch plate 73 is prevented from following the movement of the top latch plate 75 due to the presence of the finger 93 of the reset lever which engages the pawl 94 of the bottom latch plate 73. Thus, the torsion spring 87 biasing the top and bottom plates relative to one another is loaded during continued relative rotation of the top latch plate tending to bias the bottom plate 73 to follow the top plate 75.

FIG. 20 illustrates the relative positions of the interrupter assembly elements immediately after the plunger 119 has reached the innermost position abutting the plunger stop 117. As shown in the figure, the main latch plate 92 has moved past the primary latch lever 106 by a distance sufficient to permit the latch surface 105 of the plate 92 to engage the corresponding surface of the lever 106. The secondary latch lever 108 has moved under bias of the spring 111 to a position abutting the rear of the primary lever 106 so as to hold the primary lever against the moment force exerted on the lever by the spring loaded latch plate 92, and the spring plunger 120 has been pivoted into engagement with the secondary lever 108 to prevent the secondary lever from being jarred loose by the impact of the plunger 116 against the plunger stop 117. The opening spring 110 has been loaded and is retained in this position by the latching assembly 60, and the plunger return springs 118 have also been loaded and are already beginning to pull the plunger 116 back toward a retracted position away from the plunger stop 117.

During the final stages of movement of the latch plate 92 toward the position shown in FIG. 20, the set screw 91 engages the arm 90 to move the finger 93 of lever 89 away from contact with the pawl 94 of the bottom latch plate 73 so that the plate 73 is free to move under bias of the spring 87 in the clockwise direction. In this manner, the conductor 72 is pulled from the contact-closed position to the position shown in the figure. At the same time, the tab 95 of the main latch plate 92 rotates the top latch plate 75 into latching engagement with the latch lever 77 that is spring biased toward the position shown in FIG. 20, so as to return automatically to that position upon de-energization of the close solenoid actuator 82.

Figure 21:
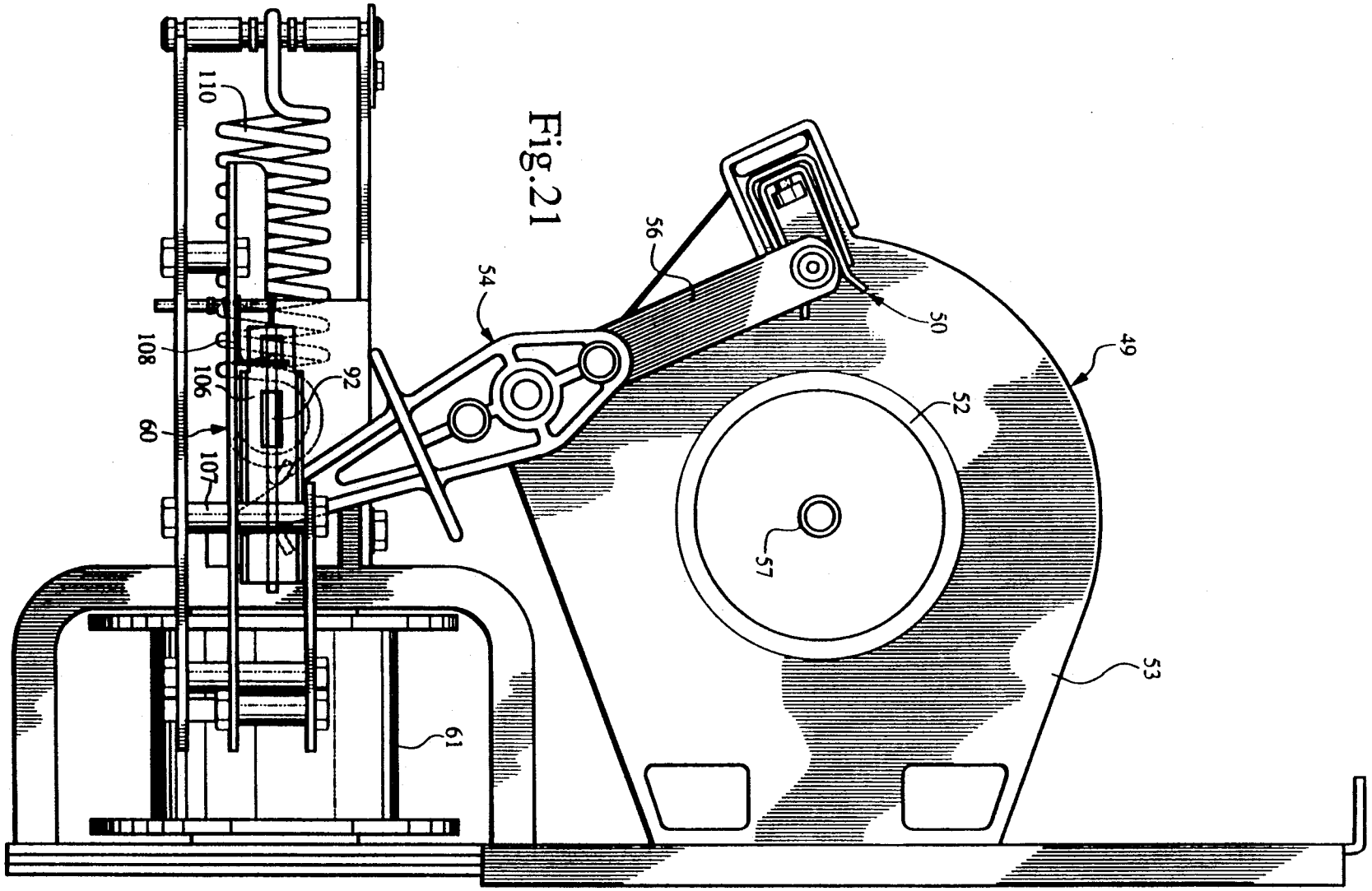
FIG. 21 is a view similar to FIG. 16, with the interrupter shown in the closed position.

The final position of the movable arm 56 of the second contact 54 of the interrupter is shown in FIG. 21, wherein the latch plate 92 has moved the arm 56 to the closed position in contact with the fixed contact 50 so that current can flow across the recloser apparatus.

Figure 8:
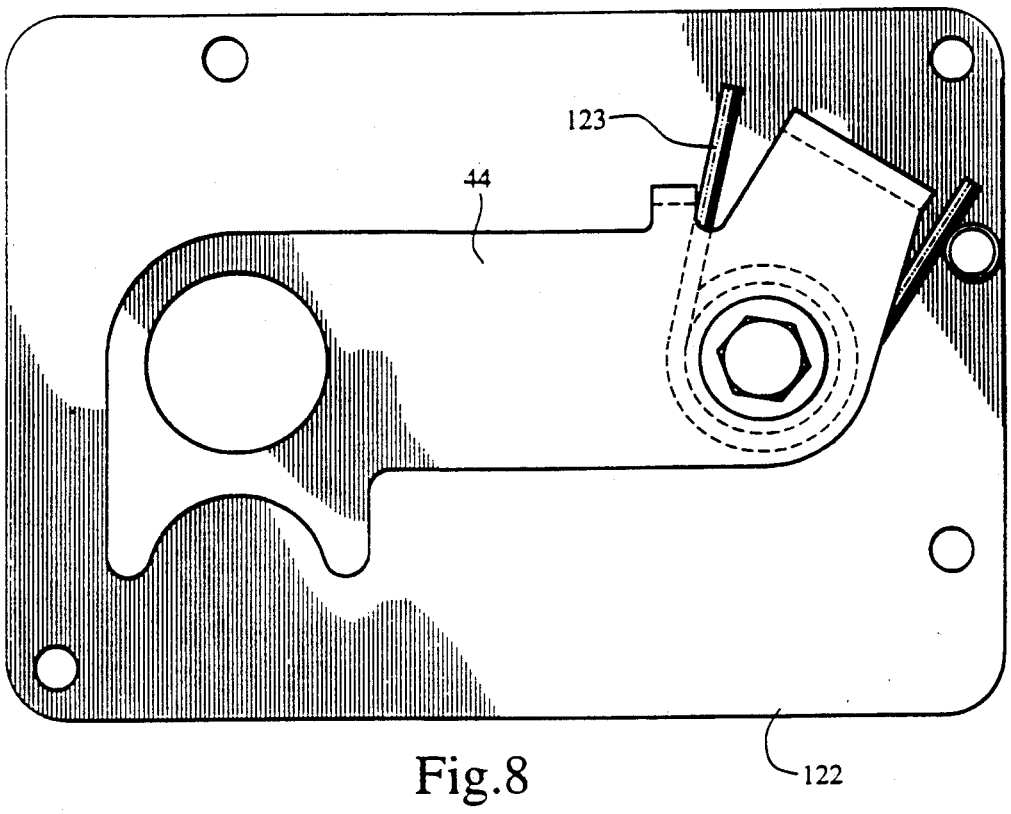
FIG. 8 is a front elevation view of the operating arm of FIG. 7.
Figure 27:
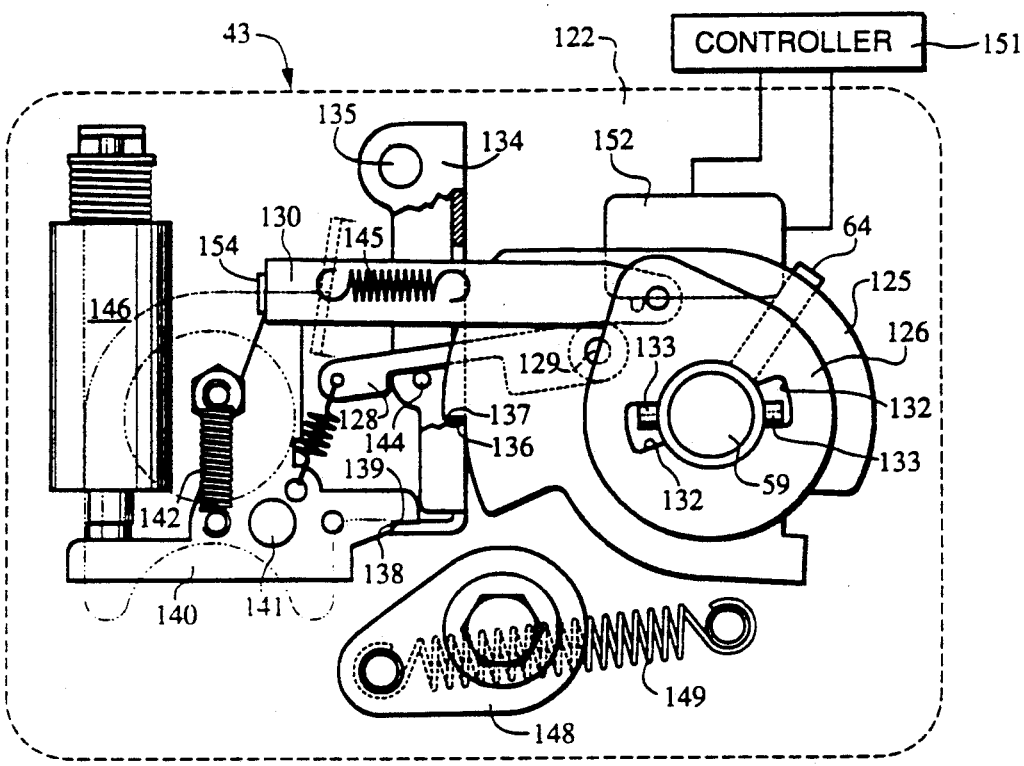
FIG. 27 is a view similar to FIG. 17, with the operating arm shown in the normal, interrupter-closed position.

It is noted that during the movement of plunger 116 and main latch plate 92 from the open position of the interrupter to the closed position, the internal operating shaft 58 does not rotate at all, but instead remains stationary, thus permitting the external operating shaft 59 and arm 44 to remain in the intermediate position as shown in FIGS. 8 and 27. Several advantages are realized from providing this feature of the invention. For example, by removing the mass of the internal and external operating shafts 58, 59 from the total mass of the mechanism which is moving during closing of the interrupter, the solenoid coil 61 may be made smaller than would be possible if the solenoid coil were required to move a larger mass including the operating arms. In addition, by maintaining the intermediate position of the arm 44 of the external assembly 43, the arm 44 serves not as a mere indicator of the position of the contacts of the interrupter, but rather as an indicator of lockout of the interrupter as discussed more fully below.

In FIG. 22, the apparatus is shown in the normal closed operating position. As can be seen, the plunger return springs 118 have pulled the plunger 116 to the retracted position so that the mass of the plunger is withdrawn from the movement path of the main latch plate 92. By pulling the plunger 116 from the path of the main latch plate 92 in this manner, the latch plate is free to move under the bias of the opening spring 110 without having to carry the mass of the plunger therewith during an interruption operation. Also, upon retraction of the plunger 116, the spring plunger 120 is moved away from the secondary lever 108 so that the secondary lever is free to rotate relative to the primary lever 106.

FAULT INDUCED INTERRUPTION

During normal operation of the recloser, when a fault is experienced by the apparatus, it is sensed by the current transformer 46, and the control means initiates fault induced interruption of the current. Turning to FIG. 23, once the fault has been sensed, the control means delivers a signal to the open solenoid 112 causing the solenoid actuator to move the secondary latch lever 108 in a counterclockwise direction so that the secondary lever releases engagement with the primary lever 106 and the primary lever is free to move under the moment forces exerted on the lever 106 by the loaded latch plate 92. As shown in the figure, the latch lever 106 is on the verge of releasing its hold on the latch plate 92.

Once the latch plate 92 is released, the opening spring 110 pulls the latch plate 92 to the position shown in FIG. 12, and the movable arm 56 of the second contact 54 is moved in the direction of the arrow in FIG. 24 to the open position illustrated in FIG. 16. As mentioned above, during movement of the movable arm 56 between the closed and open position, an arc forms across the separation distance between the contacts and is extinguished by the insulating gas within the housing with the assistance of the elongation of the arc which is carried out by the geometry of the movable arm 56 and by the ring electrode coil which spins the arc within the ring electrode 52.

After interruption of the current through the apparatus, the control means operates to initiate reclosing of the interrupter after a predetermined delay time has elapsed. This automatic closing operation is similar to the manual closing operation discussed above, but does not involve any movement of the external or internal operating shafts 59, 58. Instead, the control means delivers a pulse to the close solenoid actuator 82 which, in turn, actuates unlatching of the auxiliary contact assembly 66. Movement of the top and bottom latch plates 75, 73 of the auxiliary contact assembly 66 causes the circuit to the coil 61 to be closed and the closing sequence continues in the manner discussed above.

If upon closing of the interrupter, the fault turns out to be temporary and no further fault current is sensed by the current transformer 46, then the recloser apparatus continues under normal conditions until such time as a further fault is sensed or until the apparatus is manually locked out in a manner to be described.

However, if upon reclosing of the interrupter a fault current is again sensed by the current transformer 46, then the control means again initiates interruption in the manner already described and the current is again interrupted. This closing and opening sequence is repeated for any desired number of cycles depending upon the programming of the control means and typically is carried out at least twice in order to give the fault a chance to clear prior to final lockout of the apparatus.

Once the control means has cycled the interrupter through the predetermined number of closing and opening operations, a pulse is delivered to the open solenoid actuator 112 and the interrupter is opened for a last time. At the same time as this final opening operation is being carried out, a lockout pulse is also delivered to the solenoid 146 in the external operating assembly 43 as shown in FIG. 28. This actuation of the solenoid causes the secondary latch lever 140 to rotate against the action of the spring 142 in a counterclockwise direction so that the primary latch lever 134 is released from engagement with the secondary lever and is pulled in a clockwise direction by the spring 145.

Upon clockwise rotation of the primary lever 134, the latch plate 125 rotates in the counterclockwise direction due to the bias of the spring 123 and rotates the arm 44 to the lower position shown in FIGS. 28 and 10. As shown in phantom lines in FIG. 28, the radial pin 64 on the external shaft 59 rotates with the shaft during rotation of the latch plate 124 and engages the internal shaft 58 to cause the lower finger 100 of the internal shaft 58 to engage the lockout bracket 97 and move the bracket to the lockout position shown in FIG. 23.

Thus, in addition to serving as an indicator that the interrupter has been cycled through the complete opening and reclosing sequence and is in a lockout condition, the arm and the external operating assembly 43 also operate to actually carry out lockout of the interrupter so that once moved to the lockout position, the only way in which the interrupter may be subsequently reclosed is manually through operation of the external operating arm 44.

If after lockout the arm 44 is manually moved to the upper position shown in FIG. 11, and a fault is still present, then the fault is sensed immediately upon closing of the interrupter and the control means delivers a pulse to the solenoid actuator 146 in the external operating assembly 43 and the latch plate 125 is immediately tripped and the arm returned to the lower, lockout position. In addition, a pulse is also delivered to the open solenoid actuator 112 and interruption is carried out in the manner discussed above. Thus, the recloser is instantaneously opened and locked out whenever an attempt is made to manually close the contacts into a fault.

MANUAL INTERRUPTION

If the recloser is to be taken out of service for any reason such as to permit maintenance work to be carried out on the distribution system, the recloser apparatus may be manually opened by pulling the arm 44 to the lower position as shown in FIG. 10.

Figure 30:
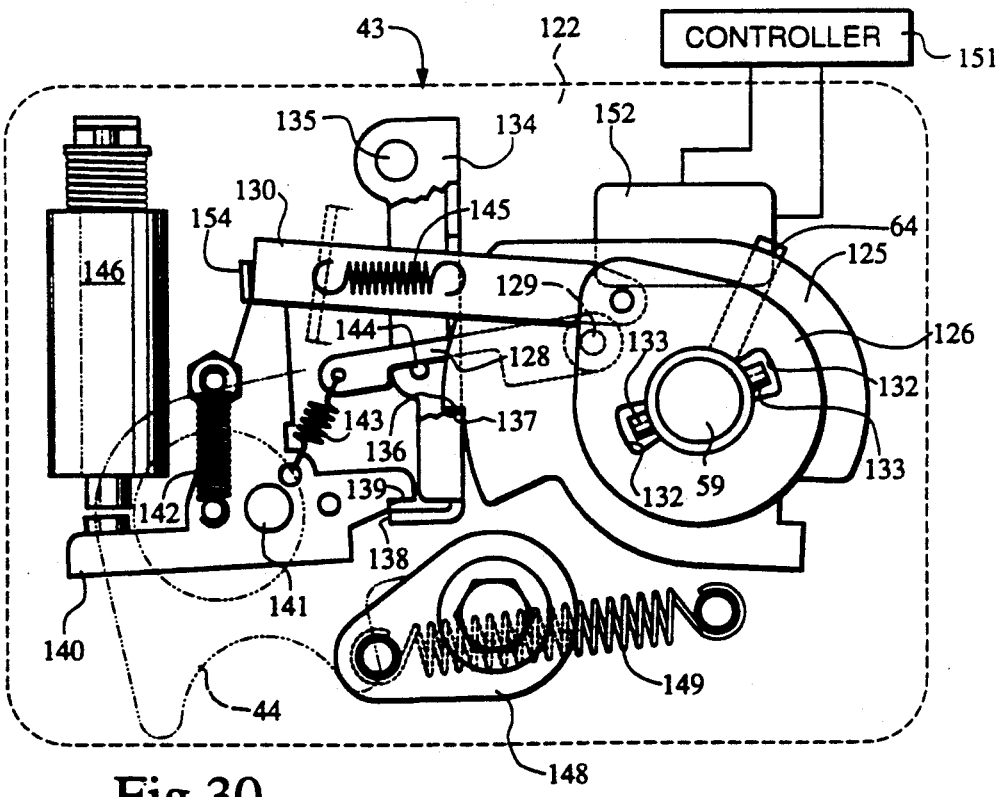
FIG. 30 is a view similar to FIG. 17, with the operating arm shown moving toward the lockout position during manual operation of the operating arm.

When the arm 44 is manually moved to the lower position, the shaft 59 and link plate 126 are rotated against the bias of the torsion spring 127 relative to the latch plate 124 and the link arm 130 is moved into engagement with a tab 154 provided at an upper end of the secondary latch lever 140, as shown in FIG. 30. Movement of the secondary latch lever 140 in the counterclockwise direction causes unlatching of the primary latch lever 134 and the latch plate 125 so that the operating shaft 59 is free to rotate in the counterclockwise direction, thus causing simultaneous rotation of the internal operating shaft 58 via the interengaging pins 63, 64.

Figure 25:
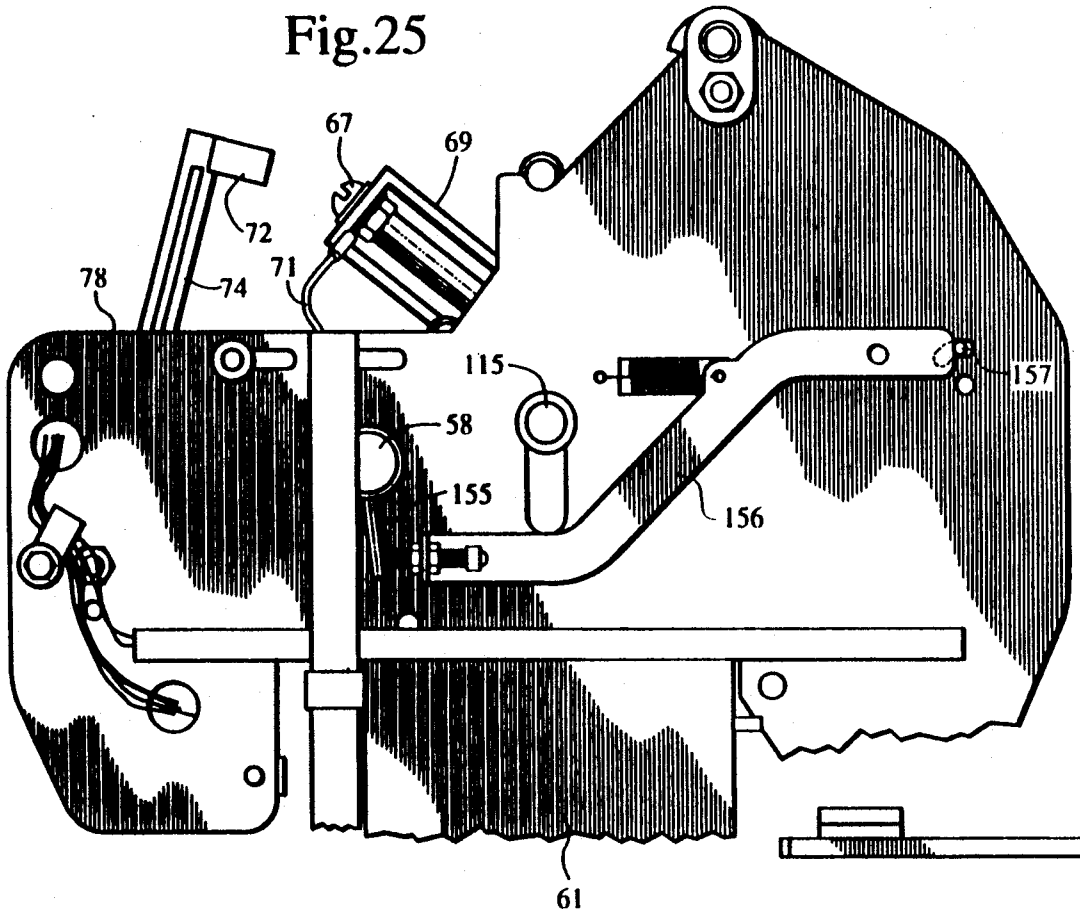
FIG. 25 is a bottom plan view of the base plate of the interrupter assembly.

Upon rotation of the internal shaft 58, a radially extending pin 155 provided on the shaft 58 at an end of the shaft located beneath the interrupter bracket 78, as shown in FIG. 25, is rotated to cause linear movement of the spring biased cam bar 156. An end of the bar 156 remote from the radial pin 155 is disposed adjacent a downward extending pin 157 provided on the secondary latch lever 108 so that the secondary latch lever is pivoted under force of the bar 156 to a position withdrawn from engagement with the primary latch lever 106. Thus, the main latch plate 92 is released from the primary latch lever 106 and moves to the open position as shown in FIG. 12, and the movable arm 56 travels to the position shown in FIG. 16.

ONE-SHOT-TO-LOCKOUT

The one-shot-to-lockout lever 147 is illustrated in a non-actuated position in FIG. 31, and is pivotally supported on the external mounting plate 22 so as to be movable in a clockwise direction to an actuated position as shown in FIG. 32.

When it is desired to convert the recloser apparatus into a one-shot interrupter, the lever 147 is moved to the position shown in FIG. 32, thus causing actuation of the contact switch 150. Closing of this switch delivers a signal to the control means 151 that a one-shot-to-lockout operation is desired. Thereafter, if a fault is sensed by the current transformer 46, a pulse is delivered to both the solenoid actuator 146 of the external operating assembly 43 and the open solenoid actuator 112 in order that an opening and lockout operation is carried out in a manner already described.

MANUAL "SLOW-CLOSE" OPERATION

As discussed above, it is possible to move the main latch plate 92 from the unlatched, open position to the latched, closed position without actuating the high voltage solenoid coil 61, merely by rotating the internal operating shaft 58 in the counterclockwise direction as viewed in FIG. 12. This operation is carried out with the assistance of a tool that engages the pin 63*a* of the shaft 58 to permit manual rotation thereof.

Typically, the slow-close operation is used in the laboratory or workshop where the recloser is removed from the distribution system and no source of power for the coil 61 is available.

One advantageous feature resulting from the inventive construction of the illustrated recloser apparatus resides in the attribute of the internal operating shaft 58 functioning solely as a slave to operations initiated from outside the tank 40.

For example, the only three occasions on which rotation of the internal operating shaft 58 occurs are during manual opening of the interrupter, lockout, and slow closing of the interrupter assembly 49. During both the manual opening and lockout operations, the internal shaft 58 is rotated by driving force from the external operating shaft 59, and during slow closing, a separate tool is employed.

By providing this attribute of the apparatus, it is possible to provide an operating assembly that communicates with the interrupter assembly 49, but which is isolated from the normal operations of the auxiliary contact assembly 66 and the main latching assembly 60 so that these assemblies are free to operate to move the contacts 50, 54 between the open and closed positions without carrying the mass of the operating shafts 58, 59, and their related components.

Although the invention has been described with reference to the illustrated preferred embodiment, it is noted that substitutions may be made and equivalents employed herein without departing from the scope of the invention as set forth in the attached claims.

What is claimed:

1. A recloser apparatus comprising:

an enclosure;

a current interrupter disposed within the enclosure and including a pair of relatively movable contacts movable between a closed, current-carrying position and an open, current-interrupting position;

first contact moving means for moving the contacts to the closed, current-carrying position;

second contact moving means for moving the contacts to the open, current-interrupting position;

control means for electronically controlling operation of the first and second contact moving means, the control means including sensing means for sensing a fault current experienced by the apparatus, fault induced interruption initiating means for initiating operation of the second contact moving means in response to a fault current sensed by the sensing means, and closing means for initiating operation of the first contact moving means after each one of a predetermined number of operations of the fault induced interruption initiating means, the fault induced interruption initiating means operating to repeatedly initiate operation of the second contact moving means after each operation of the closing means in response to a continued sensed fault current; and an operating assembly including an operating arm which is movable relative to the enclosure between an upper, intermediate and lower position, the operating assembly including signalling means for signalling the control means to initiate operation of the first contact moving means when the operating arm is manually moved to the upper position, lockout means for locking the first contact moving means against subsequent movement when the operating arm is in the lower position, and operating arm moving means for automatically moving the operating arm to the lower position, the control means including lockout actuation means for actuating the operating arm moving means after the fault induced interruption initiating means has initiated said predetermined number of operations of the second contact moving means and in response to a sensed fault current so that the operating arm is moved to the lower position and serves as in indication that the apparatus is in a lockout condition, the operating assembly including an internal operating shaft having a first end coupled tot he operating arm and a second end coupled to the lockout means, the internal shaft rotating with the arm when the arm is moved from the intermediate to lower position and remaining stationary when the arm is moved from the intermediate to upper position.

2. The recloser apparatus as recited in claim 1, further comprising one-shot-to-lockout means for preventing operation of the closing means so that the contacts move to and remain in the open, current-interrupting position after an initial operation of the fault induced interruption initiating means.

3. A recloser apparatus comprising:

an enclosure;

a current interrupter disposed within the enclosure and including a pair of relatively movable contacts movable between a closed, current-carrying position and an open, current-interrupting position;

first contact moving means for moving the contacts to the closed, current-carrying position;

second contact moving means for moving the contacts to the open current-interrupting position;

control means for electronically controlling operation of the first and second contact moving means, the control means including sensing means for sensing a fault current experienced by the apparatus, fault induced interruption initiating means for initiating operation of the second contact moving means in response to a fault current sensed by the sensing means, and closing means for initiating operation of the first contact moving means after each one of a predetermined number of operations of the fault induced interruption initiating means, the fault induced interruption initiating means operating to repeatedly initiate operation of the second contact moving means after each operation of the closing means in response to a continued sensed fault current; and an operating assembly including an operating arm which is movable relative to the enclosure between an upper, intermediate and lower position, the operating assembly including signalling means for signalling the control means to initiate operation of the first contact moving means when the operating arm is manually moved tot he upper position and lockout means for locking the first contact moving means against subsequent movement when the operating arm is in the lower position; and operating arm moving means for automatically moving the operating arm to the lower position, the control means including closure preventing means for actuating the operating arm moving means when the operating arm is manually moved tot he upper position and a fault current is sensed by the sensing means.

4. The recloser apparatus as recited in claim 1, wherein one of the contacts is movable and the other contact is fixed, the first contact moving means including an electromagnetic solenoid coil, a plunger movable within the solenoid coil, and force transmitting means connected between the plunger and the movable contact for moving the movable contact into the closed, current-carrying position as the plunger moves toward the solenoid coil upon energization of the solenoid coil.

5. The recloser apparatus as recited in claim 4, further comprising plunger retracting means for moving the plunger away from the solenoid coil after the solenoid coil has been de-energized without changing the position of the movable contact.

6. The recloser apparatus as recited in claim 4, wherein the force transmitting means includes a latch plate connected to the movable contact and movable between a first position in which the movable contact is in the closed position and a second position in which the movable contact is in the open position, the second contact moving means including biasing means for biasing the latch plate toward the second position.

7. The recloser apparatus as recited in claim 6, wherein the second contact moving means includes latch plate retaining means for retaining the latch plate in the first position against the bias of the biasing means and releasing means for releasing the latch plate and permitting the latch plate to move under the bias of the biasing means to the second position, the fault induced interruption initiating means including an opening solenoid actuator operatively connected to the releasing means such that upon energization of the opening solenoid actuator the releasing means operates.

8. The recloser apparatus as recited in claim 4, wherein the solenoid coil forms a part of a coil circuit provided with a switch movable between an open and closed position, the force transmitting means including structure for resetting the switch to the open position at substantially the same time that the force transmitting member moved the movable contact to the closed position.

9. A recloser apparatus comprising:

an enclosure;

a current interrupter disposed within the enclosure and including a fixed contact and a movable contact, the movable contact being movable between a closed, current-carrying position and an open, current-interrupting position;

first contact moving means for moving the contacts to the closed, current-carrying position the first contact moving means including an electromagnetic solenoid coil, a plunger movable within the solenoid coil, and force transmitting means connected between the plunger and the movable contact for moving the movable contact into the closed, current-carrying position as the plunger moves toward the solenoid coil upon energization of the solenoid coil;

second contact moving means for moving the contacts to the open, current-interrupting position;

control means for electronically controlling operation of the first and second contact moving means, the control means including sensing means for sensing a fault current experienced by the apparatus, fault induced interruption initiating means for initiating operation of the second contact moving means in response to a fault current sensed by the sensing means, and closing means for initiating operation of the first contact moving means after each one of a predetermined number of operations of the fault induced interruption initiating means, the fault induced interruption initiating means operating to repeatedly initiate operation of the second contact moving means after each operation of the closing means in response to a continued sensed fault current;

an operating assembly including an operating arm which is movable relative to the enclosure between an upper, intermediate and lower position, the operating assembly including circuit signalling means for signalling the control means to initiate operation of the first contact moving means when the operating arm is manually moved to the upper position and lockout means for locking the first contact moving means against subsequent movement when the operating arm is in the lower position; and slow close means for by-passing operation of the electromagnetic solenoid coil and for moving the movable contact to the closed position.

10. A recloser apparatus comprising:

an enclosure ;

a current-interrupter disposed within the enclosure and including at least one pair of relatively movable contacts movable contacts movable between a closed, current-carrying position and an open, current-interrupting position;

first contact moving means for moving the contacts to the closed, current-carrying position;

second contact moving means for moving the contacts to the open, current-interrupting position;

control means for electronically controlling operation of the first and second contact moving means, the control means including sensing means for sensing a fault current experienced by the apparatus, fault induced interruption initiating means for initiating operation of the second contact moving means in response to a fault current sensed by the sensing means, and closing means for initiating operation of the first contact moving means after each one a predetermined number of operation of the fault induced interruption initiating means, the fault induced interruption initiating means operating to repeatedly initiate operation of the second contact moving means after each operation of the closing means in response to a continued sensed fault current;

an operating assembly accessible from outside the enclosure and including an operating arm movable relative to the enclosure between an upper, intermediate and lower position assembly including signalling means for signalling the control means to initiate operation of the first contact moving means when the operating arm is manually moved to the upper position and actuating means for actuating the second contact moving means for actuating the second contact moving means when the operating arm is manually moved to the lower position; and lockout signalling means for automatically moving the operating arm to the lower position after the control means has initiated said predetermined number of operations of the fault induced current interrupting means and in response to a sensed fault current by the sensing means so that the operating arm serves as an indicator of a lockout condition in the apparatus.

11. The recloser apparatus as recited in claim 10, wherein the operating arm includes lockout actuating means for preventing the first contact moving means from operating when the operating arm is in the lower position.

12. The recloser apparatus as recited in claim 10, further comprising one-shot-to-lockout means for preventing operation of the closing means so that the contacts move to and remain in the open, current-interrupting position after an initial operation of the fault induced interruption initiating means.

13. The recloser apparatus as recited in claim 10, wherein the lockout signalling means includes operating arm moving means for moving the operating arm to the lower position, the control means including closure preventing means for actuating the operating arm moving means when the operating arm is manually moved to the upper position and a fault current is sensed by the sensing means.

14. The recloser apparatus as recited in claim 10, wherein one of the contacts is movable and the other contact is fixed, the first contact moving means including an electromagnetic solenoid coil, a plunger movable within the solenoid coil, and force transmitting means connected between the plunger and the movable contact for moving the movable contact into the closed, current-carrying position as the plunger moves toward the solenoid coil upon energization of the solenoid coil.

15. The recloser apparatus as recited in claim 16, further comprising plunger retracting means for moving the plunger away from the solenoid coil without changing the position of the movable contact after the solenoid coil has been de-energized.

16. The recloser apparatus as recited in claim 14, wherein the force transmitting means includes a latch plate connected to the movable contact and movable between a first position in which the movable contact is in the closed position and a second position in which the movable contact is in the open position, the second contact moving means including biasing means for biasing the latch plate toward the second position.

17. The recloser apparatus as recited in claim 16, wherein the second contact moving means includes latch plate retaining means for retaining the latch plate in the first position against the bias of the biasing means and releasing means for releasing the latch plate and permitting the latch plate to move under the biasing force of the biasing means to the second position, the fault induced interruption initiating means including an opening solenoid actuator operatively connected to the releasing means such that upon energization of the opening solenoid actuator the releasing means operates.

18. A recloser apparatus comprising:

an enclosure;

a current interrupter disposed within the enclosure and including a pair of relatively movable contacts movable between a closed, current-carrying position and an open, current-interrupting position;

first contact moving means for moving the contacts to the closed position;

second contact moving means for moving the contacts to the open position;

an operating assembly manually accessible from outside the enclosure and including an operating arm which is movable between an upper, intermediate and lower position, the operating assembly including contact closing means for initiating operation of the first contact moving means when the operating arm is manually moved to the upper position and lockout actuating means for actuating the second contact moving means and for preventing subsequent operation of the first contact moving means when the operating arm is manually moved to the lower position;

sensing means for sensing a fault current experienced by the apparatus;

an electronic control assembly including control means for initially actuating the second contact moving means in response to a sensed fault current and for alternately actuating the first and second contact moving means for a predetermined number of opening cycles in response to a further sensed fault current; and lockout signalling means for automatically moving the operating arm in response to a signal from the control means to the lower position once the control means has actuated the first and second contact moving means for the predetermined number of opening cycles.

* * * * *